US011140921B2

(12) United States Patent
Sebastian et al.

(10) Patent No.: US 11,140,921 B2
(45) Date of Patent: Oct. 12, 2021

(54) RESERVOIR AND HEATER SYSTEM FOR CONTROLLABLE DELIVERY OF MULTIPLE AEROSOLIZABLE MATERIALS IN AN ELECTRONIC SMOKING ARTICLE

(71) Applicant: RAI Strategic Holdings, Inc., Winston-Salem, NC (US)

(72) Inventors: Andries Don Sebastian, Clemmons, NC (US); Karen V. Taluskie, Winston-Salem, NC (US); Stephen Benson Sears, Siler City, NC (US); Bradley James Ingebrethsen, Long Branch, NJ (US); Balager Ademe, Winston-Salem, NC (US); Steven Lee Alderman, Lewisville, NC (US); William Robert Collett, Lexington, NC (US); Grady Lance Dooly, Winston-Salem, NC (US); Charles Jacob Novak, III, Winston-Salem, NC (US)

(73) Assignee: RAI Strategic Holdings, Inc., Winston-Salem, NC (US)

( * ) Notice: Subject to any disclaimer, the term of this patent is extended or adjusted under 35 U.S.C. 154(b) by 0 days.

(21) Appl. No.: 16/718,831

(22) Filed: Dec. 18, 2019

(65) Prior Publication Data

US 2020/0138099 A1 May 7, 2020

Related U.S. Application Data

(63) Continuation of application No. 15/988,597, filed on May 24, 2018, now Pat. No. 10,524,512, which is a (Continued)

(51) Int. Cl.
*A24F 47/00* (2020.01)
*A24F 40/50* (2020.01)

(Continued)

(52) U.S. Cl.
CPC ..... *A24F 40/50* (2020.01); *A24F 40/30* (2020.01); *A24F 40/10* (2020.01); *A24F 40/44* (2020.01)

(58) Field of Classification Search
CPC ..... A24F 40/30; A24F 40/44; A24F 47/008
See application file for complete search history.

(56) References Cited

U.S. PATENT DOCUMENTS 1,771,366 A 7/1930 Wyss et al.
2,057,353 A 10/1936 Whittemore, Jr.

(Continued)

FOREIGN PATENT DOCUMENTS

AU 276250 7/1965
CA 2 641 869 5/2010

(Continued)

*Primary Examiner* — Eric Yaary
(74) *Attorney, Agent, or Firm* — Womble Bond Dickinson (US) LLP

(57) ABSTRACT

The present disclosure relates to an electronic smoking article that provides for improved aerosol delivery. Particularly, the article provides for separate delivery of two or more components of an aerosol precursor composition to one or more heaters so as to control the rate of delivery or the rate of heating of the separate components of the aerosol precursor composition.

21 Claims, 5 Drawing Sheets

Related U.S. Application Data continuation of application No. 13/536,439, filed on Jun. 28, 2012, now abandoned.

(51) Int. Cl.

| | |
|---|---|
| ***A24F 40/30*** | (2020.01) |
| *A24F 40/10* | (2020.01) |
| *A24F 40/44* | (2020.01) |

(56) References Cited

U.S. PATENT DOCUMENTS 2,104,266 A 1/1938 McCormick
2,805,669 A 9/1957 Meriro
3,200,819 A 8/1965 Gilbert
3,316,919 A 5/1967 Green et al.
3,398,754 A 8/1968 Tughan
3,419,015 A 12/1968 Wochnowski
3,424,171 A 1/1969 Rooker
3,476,118 A 11/1969 Luttich
4,054,145 A 10/1977 Berndt et al.
4,131,117 A 12/1978 Kite et al.
4,150,677 A 4/1979 Osborne
4,190,046 A 2/1980 Virag
4,219,032 A 8/1980 Tabatznik et al.
4,259,970 A 4/1981 Green, Jr.
4,284,089 A 8/1981 Ray
4,303,083 A 12/1981 Burruss, Jr.
4,449,541 A 5/1984 Mays et al.
4,506,682 A 3/1985 Muller
4,635,651 A 1/1987 Jacobs
4,674,519 A 6/1987 Keritsis et al.
4,708,151 A 11/1987 Shelar
4,714,082 A 12/1987 Banerjee et al.
4,735,217 A 4/1988 Gerth et al.
4,756,318 A 7/1988 Clearman et al.
4,771,795 A 9/1988 White et al.
4,776,353 A 10/1988 Lilja et al.
4,793,365 A 12/1988 Sensabaugh, Jr. et al.
4,800,903 A 1/1989 Ray et al.
4,819,665 A 4/1989 Roberts et al.
4,821,749 A 4/1989 Toft et al.
4,830,028 A 5/1989 Lawson et al.
4,836,224 A 6/1989 Lawson et al.
4,836,225 A 6/1989 Sudoh
4,848,374 A 7/1989 Chard et al.
4,848,376 A 7/1989 Lilja et al.
4,874,000 A 10/1989 Tamol et al.
4,880,018 A 11/1989 Graves, Jr. et al.
4,887,619 A 12/1989 Burcham, Jr. et al.
4,907,606 A 3/1990 Lilja et al.
4,913,168 A 4/1990 Potter et al.
4,917,119 A 4/1990 Potter et al.
4,917,128 A 4/1990 Clearman et al.
4,922,901 A 5/1990 Brooks et al.
4,924,888 A 5/1990 Perfetti et al.
4,928,714 A 5/1990 Shannon
4,938,236 A 7/1990 Banerjee et al.
4,941,483 A 7/1990 Ridings et al.
4,941,484 A 7/1990 Clapp et al.
4,945,931 A 8/1990 Gori
4,947,874 A 8/1990 Brooks et al.
4,947,875 A 8/1990 Brooks et al.
4,972,854 A 11/1990 Kiernan et al.
4,972,855 A 11/1990 Kuriyama et al.
4,986,286 A 1/1991 Roberts et al.
4,987,906 A 1/1991 Young et al.
5,005,593 A 4/1991 Fagg
5,019,122 A 5/1991 Clearman et al.
5,022,416 A 6/1991 Watson
5,042,510 A 8/1991 Curtiss et al.
5,056,537 A 10/1991 Brown et al.
5,060,669 A 10/1991 White et al.
5,060,671 A 10/1991 Counts et al.
5,065,775 A 11/1991 Fagg
5,072,744 A 12/1991 Luke et al.
5,074,319 A 12/1991 White et al.
5,076,296 A 12/1991 Nystrom et al.
5,093,894 A 3/1992 Deevi et al.
5,095,921 A 3/1992 Losee et al.
5,097,850 A 3/1992 Braunshteyn et al.
5,099,862 A 3/1992 White et al.
5,099,864 A 3/1992 Young et al.
5,103,842 A 4/1992 Strang et al.
5,121,757 A 6/1992 White et al.
5,129,409 A 7/1992 White et al.
5,131,415 A 7/1992 Munoz et al.
5,143,097 A 9/1992 Sohn et al.
5,144,962 A 9/1992 Counts et al.
5,146,934 A 9/1992 Deevi et al.
5,159,940 A 11/1992 Hayward et al.
5,159,942 A 11/1992 Brinkley et al.
5,179,966 A 1/1993 Losee et al.
5,211,684 A 5/1993 Shannon et al.
5,220,930 A 6/1993 Gentry
5,224,498 A 7/1993 Deevi et al.
5,228,460 A 7/1993 Sprinkel, Jr. et al.
5,230,354 A 7/1993 Smith et al.
5,235,992 A 8/1993 Sensabaugh
5,243,999 A 9/1993 Smith
5,246,018 A 9/1993 Deevi et al.
5,249,586 A 10/1993 Morgan et al.
5,261,424 A 11/1993 Sprinkel, Jr.
5,269,327 A 12/1993 Counts et al.
5,285,798 A 2/1994 Banerjee et al.
5,293,883 A 3/1994 Edwards
5,301,694 A 4/1994 Raymond
5,303,720 A 4/1994 Banerjee et al.
5,318,050 A 6/1994 Gonzalez-Parra et al.
5,322,075 A 6/1994 Deevi et al.
5,322,076 A 6/1994 Brinkley et al.
5,339,838 A 8/1994 Young et al.
5,345,951 A 9/1994 Serrano et al.
5,353,813 A 10/1994 Deevi et al.
5,357,984 A 10/1994 Farrier et al.
5,360,023 A 11/1994 Blakley et al.
5,369,723 A 11/1994 Counts et al.
5,372,148 A 12/1994 McCafferty et al.
5,377,698 A 1/1995 Litzinger et al.
5,388,574 A 2/1995 Ingebrethsen et al.
5,388,594 A 2/1995 Counts et al.
5,408,574 A 4/1995 Deevi et al.
5,435,325 A 7/1995 Clapp et al.
5,445,169 A 8/1995 Brinkley et al.
5,449,117 A * 9/1995 Muderlak ..... A47K 17/00 222/646
5,468,266 A 11/1995 Bensalem et al.
5,468,936 A 11/1995 Deevi et al.
5,479,948 A 1/1996 Counts et al.
5,498,850 A 3/1996 Das
5,498,855 A 3/1996 Deevi et al.
5,499,636 A 3/1996 Baggett, Jr. et al.
5,501,237 A 3/1996 Young et al.
5,505,214 A 4/1996 Collins et al.
5,530,225 A 6/1996 Hajaligol
5,551,450 A 9/1996 Hemsley
5,551,451 A 9/1996 Riggs et al.
5,564,442 A 10/1996 MacDonald et al.
5,573,692 A 11/1996 Das et al.
5,591,368 A 1/1997 Fleischhauer et al.
5,593,792 A 1/1997 Farrier et al.
5,595,577 A 1/1997 Bensalem et al.
5,596,706 A 1/1997 Sikk et al.
5,611,360 A 3/1997 Tang
5,613,504 A 3/1997 Collins et al.
5,613,505 A 3/1997 Campbell et al.
5,649,552 A 7/1997 Cho et al.
5,659,656 A 8/1997 Das
5,665,262 A 9/1997 Hajaligol et al.
5,666,976 A 9/1997 Adams et al.
5,666,977 A 9/1997 Higgins et al.
5,666,978 A 9/1997 Counts et al.
5,692,525 A 12/1997 Counts et al.
5,692,526 A 12/1997 Adams et al.
5,708,258 A 1/1998 Counts et al.

(56) References Cited

U.S. PATENT DOCUMENTS 5,711,320 A 1/1998 Martin
5,726,421 A 3/1998 Fleischhauer et al.
5,727,571 A 3/1998 Meiring et al.
5,730,158 A 3/1998 Collins et al.
5,750,964 A 5/1998 Counts et al.
5,799,663 A 9/1998 Gross et al.
5,816,263 A 10/1998 Counts et al.
5,819,756 A 10/1998 Mielordt
5,829,453 A 11/1998 White et al.
5,865,185 A 2/1999 Collins et al.
5,865,186 A 2/1999 Volsey, II
5,878,752 A 3/1999 Adams et al.
5,880,439 A 3/1999 Deevi et al.
5,915,387 A 7/1999 Baggett, Jr. et al.
5,934,289 A 8/1999 Watkins et al.
5,954,979 A 9/1999 Counts et al.
5,967,148 A 10/1999 Harris et al.
6,026,820 A 2/2000 Haggett, Jr. et al.
6,164,287 A 2/2000 White
6,033,623 A 3/2000 Deevi et al.
6,040,560 A 3/2000 Fleischhauer et al.
6,053,176 A 4/2000 Adams et al.
6,089,857 A 7/2000 Matsuura et al.
6,095,153 A 8/2000 Kessler et al.
6,116,247 A 9/2000 Banyasz et al.
6,119,700 A 9/2000 Fleischhauer et al.
6,125,853 A 10/2000 Susa et al.
6,125,855 A 10/2000 Nevett et al.
6,125,866 A 10/2000 Nichols et al.
6,155,268 A 12/2000 Takeuchi
6,182,670 B1 2/2001 White
6,196,218 B1 3/2001 Voges
6,216,706 B1 4/2001 Kumar et al.
6,289,898 B1 9/2001 Fournier et al.
6,349,729 B1 2/2002 Pham
6,357,671 B1 3/2002 Cewers
6,418,938 B1 7/2002 Fleischhauer et al.
6,446,426 B1 8/2002 Sweeney et al.
6,532,965 B1 3/2003 Abhulimen et al.
6,598,607 B2 7/2003 Adiga et al.
6,601,776 B1 8/2003 Oljaca et al.
6,615,840 B1 9/2003 Fournier et al.
6,688,313 B2 2/2004 Wrenn et al.
6,701,936 B2 3/2004 Shafer et al.
6,715,494 B1 4/2004 McCoy
6,730,832 B1 5/2004 Dominguez et al.
6,722,756 B2 8/2004 Shayan
6,772,756 B2 8/2004 Shayan
6,803,545 B2 10/2004 Blake et al.
6,803,550 B2 10/2004 Sharpe et al.
6,810,883 B2 11/2004 Felter et al.
6,854,461 B2 2/2005 Nichols
6,854,470 B1 2/2005 Pu
6,994,096 B2 2/2006 Rostami et al.
7,011,096 B2 3/2006 Li et al.
7,017,585 B2 3/2006 Li et al.
7,025,066 B2 4/2006 Lawson et al.
7,117,867 B2 10/2006 Cox et al.
7,163,015 B2 1/2007 Moffitt
7,173,322 B2 2/2007 Cox et al.
7,185,659 B2 3/2007 Sharpe et al.
7,234,470 B2 6/2007 Yang
7,290,549 B2 11/2007 Banerjee et al.
7,293,565 B2 11/2007 Griffin et al.
7,392,809 B2 7/2008 Larson et al.
7,513,253 B2 4/2009 Kobayashi et al.
7,647,932 B2 1/2010 Cantrell et al.
7,690,385 B2 4/2010 Moffitt
7,692,123 B2 4/2010 Baba et al.
7,726,320 B2 6/2010 Robinson et al.
7,810,505 B2 10/2010 Yang
7,832,410 B2 11/2010 Hon
7,878,209 B2 2/2011 Newbery et al.
7,896,006 B2 3/2011 Hamano et al.
8,066,010 B2 11/2011 Newbery et al.
8,079,371 B2 12/2011 Robinson et al.
2002/0146242 A1 10/2002 Vieira
2002/0155026 A1 10/2002 Lins
2003/0131859 A1 7/2003 Li et al.
2003/0226837 A1 12/2003 Blake et al.
2004/0020500 A1 2/2004 Wrenn et al.
2004/0129280 A1 7/2004 Woodson et al.
2004/0149296 A1 8/2004 Rostami et al.
2004/0200488 A1 10/2004 Felter et al.
2004/0224435 A1 11/2004 Shibata et al.
2004/0226568 A1 11/2004 Takeuchi et al.
2004/0255965 A1 12/2004 Perfetti et al.
2005/0016549 A1 1/2005 Banerjee et al.
2005/0016550 A1 1/2005 Katase
2005/0066986 A1 3/2005 Nestor et al.
2005/0151126 A1 7/2005 Yamakawa et al.
2005/0172976 A1 8/2005 Newman et al.
2005/0274390 A1 12/2005 Banerjee et al.
2006/0016453 A1 1/2006 Kim
2006/0032501 A1 2/2006 Hale et al.
2006/0070633 A1 4/2006 Rostami et al.
2006/0078477 A1 4/2006 Althouse et al.
2006/0162733 A1 7/2006 McGrath et al.
2006/0185687 A1 8/2006 Hearn et al.
2006/0196518 A1 9/2006 Hon
2007/0062548 A1 3/2007 Horstmann et al.
2007/0074734 A1 4/2007 Braunshteyn et al.
2007/0102013 A1 5/2007 Adams et al.
2007/0215167 A1 9/2007 Crooks et al.
2007/0283972 A1 12/2007 Monsees et al.
2008/0092912 A1 4/2008 Robinson et al.
2008/0149118 A1 6/2008 Oglesby et al.
2008/0245377 A1 10/2008 Marshall et al.
2008/0257367 A1 10/2008 Paterno et al.
2008/0276947 A1 11/2008 Martzel
2008/0302374 A1 12/2008 Wengert et al.
2009/0065010 A1 3/2009 Shands
2009/0095311 A1 4/2009 Hon
2009/0095312 A1 4/2009 Herbrich et al.
2009/0126745 A1 5/2009 Hon
2009/0188490 A1 7/2009 Hon
2009/0230117 A1 9/2009 Fernando et al.
2009/0260641 A1 10/2009 Monsees et al.
2009/0260642 A1 10/2009 Monsees et al.
2009/0272379 A1 11/2009 Thorens et al.
2009/0283103 A1 11/2009 Nielsen et al.
2009/0293892 A1 12/2009 Williams et al.
2009/0320863 A1 12/2009 Fernando et al.
2009/0324206 A1 12/2009 Young et al.
2010/0006113 A1 1/2010 Urtsev et al.
2010/0024834 A1 2/2010 Oglesby et al.
2010/0043809 A1 2/2010 Magnon
2010/0059070 A1 3/2010 Potter et al.
2010/0059073 A1 3/2010 Hoffmann et al.
2010/0065075 A1 3/2010 Banerjee et al.
2010/0083959 A1 4/2010 Siller
2010/0163063 A1 7/2010 Fernando et al.
2010/0200006 A1 8/2010 Robinson et al.
2010/0229881 A1 9/2010 Hearn
2010/0242974 A1 9/2010 Pan
2010/0242976 A1 9/2010 Katayama et al.
2010/0258139 A1 10/2010 Onishi et al.
2010/0300467 A1 12/2010 Kuistilla et al.
2010/0307518 A1 12/2010 Wang
2010/0313901 A1 12/2010 Fernando et al.
2011/0005535 A1 1/2011 Xiu
2011/0011396 A1 1/2011 Fang
2011/0036363 A1 2/2011 Urtsev et al.
2011/0036365 A1 2/2011 Chong et al.
2011/0073121 A1 3/2011 Levin et al.
2011/0088707 A1 4/2011 Hajaligol
2011/0094523 A1 4/2011 Thorens et al.
2011/0120480 A1 5/2011 Brenneise
2011/0126847 A1 6/2011 Zuber et al.
2011/0126848 A1 6/2011 Zuber et al.
2011/0155153 A1 6/2011 Thorens et al.
2011/0155718 A1 6/2011 Greim et al.
2011/0162663 A1 7/2011 Bryman
2011/0168194 A1 7/2011 Hon

(56) References Cited

U.S. PATENT DOCUMENTS

| | | | | |
|---|---|---|---|---|
| 2011/0180082 | A1 | 7/2011 | Banerjee et al. | |
| 2011/0226236 | A1 | 9/2011 | Buchberger | |
| 2011/0265806 | A1 | 11/2011 | Alarcon et al. | |
| 2011/0309157 | A1 | 12/2011 | Yang et al. | |
| 2012/0042885 | A1 | 2/2012 | Stone et al. | |
| 2012/0048266 | A1 | 3/2012 | Alelov | |
| 2012/0060853 | A1 | 3/2012 | Robinson et al. | |
| 2012/0111347 | A1 | 5/2012 | Hon | |
| 2012/0132643 | A1 | 5/2012 | Choi et al. | |
| 2012/0231464 | A1 | 9/2012 | Yu et al. | |
| 2012/0279512 | A1 | 11/2012 | Hon | |
| 2012/0318882 | A1 | 12/2012 | Abehasera | |
| 2013/0081623 | A1 | 4/2013 | Buchberger | |
| 2013/0081642 | A1 | 4/2013 | Safari | |
| 2013/0104916 | A1* | 5/2013 | Bellinger | A24F 47/008 131/328 |
| 2013/0192616 | A1 | 8/2013 | Tucker et al. | |
| 2013/0192621 | A1 | 8/2013 | Li et al. | |
| 2013/0220315 | A1 | 8/2013 | Conley et al. | |
| 2013/0228191 | A1 | 9/2013 | Newton | |
| 2013/0284194 | A1 | 10/2013 | Newton | |
| 2013/0298905 | A1 | 11/2013 | Levin et al. | |
| 2013/0306084 | A1 | 11/2013 | Flick | |
| 2013/0319435 | A1 | 12/2013 | Flick | |
| 2013/0340750 | A1 | 12/2013 | Thorens et al. | |
| 2013/0340775 | A1 | 12/2013 | Juster et al. | |

FOREIGN PATENT DOCUMENTS

| | | |
|---|---|---|
| CA | 2 752 255 | 8/2010 |
| CN | 1541577 | 11/2004 |
| CN | 2719043 | 8/2005 |
| CN | 200997909 | 1/2008 |
| CN | 101116542 | 2/2008 |
| CN | 101176805 | 5/2008 |
| CN | 201379072 | 1/2010 |
| DE | 10 2006 004 484 | 8/2007 |
| DE | 102006041042 | 3/2008 |
| DE | 20 2009 010 400 | 11/2009 |
| EP | 0 295 122 | 12/1988 |
| EP | 0 430 566 | 6/1991 |
| EP | 0 845 220 | 6/1998 |
| EP | 1 618 803 | 1/2006 |
| EP | 2 316 286 | 5/2011 |
| EP | 2 468 116 | 6/2012 |
| GB | 1444461 | 7/1976 |
| GB | 2469850 | 11/2010 |
| WO | WO 1986/02528 | 5/1986 |
| WO | WO 1997/48293 | 12/1997 |
| WO | WO 02/37990 | 5/2002 |
| WO | WO 2004/043175 | 5/2004 |
| WO | WO 2007/131449 | 11/2007 |
| WO | WO 2009/105919 | 9/2009 |
| WO | WO 2009/155734 | 12/2009 |
| WO | WO 2010/003480 | 1/2010 |
| WO | WO 2010/045670 | 4/2010 |
| WO | WO 2010/073122 | 7/2010 |
| WO | WO 2010/091593 | 8/2010 |
| WO | WO 2010/118644 | 10/2010 |
| WO | WO 2010/140937 | 12/2010 |
| WO | WO 2011/010334 | 1/2011 |
| WO | WO 2011/081558 | 7/2011 |
| WO | WO 2011/109849 | 9/2011 |

* cited by examiner

RESERVOIR AND HEATER SYSTEM FOR CONTROLLABLE DELIVERY OF MULTIPLE AEROSOLIZABLE MATERIALS IN AN ELECTRONIC SMOKING ARTICLE

CROSS-REFERENCE TO RELATED APPLICATIONS

The present application is a continuation of U.S. application Ser. No. 15/988,597, filed May 24, 2018, which is a continuation of U.S. application Ser. No. 13/536,438, filed Jun. 28, 2012, the disclosures of which are incorporated herein by reference in their entirety.

FIELD OF THE INVENTION

The present invention relates to aerosol delivery articles and uses thereof for yielding tobacco components or other materials in an inhalable form. The articles can be made or derived from tobacco or otherwise incorporate tobacco for human consumption.

BACKGROUND OF THE INVENTION

Many smoking articles have been proposed through the years as improvements upon, or alternatives to, smoking products based upon combusting tobacco. Exemplary alternatives have included devices wherein a solid or liquid fuel is combusted to transfer heat to tobacco or wherein a chemical reaction is used to provide such heat source. Numerous references have proposed various smoking articles of a type that generate flavored vapor, visible aerosol, or a mixture of flavored vapor and visible aerosol. Some of those proposed types of smoking articles include tubular sections or longitudinally extending air passageways.

The point of the improvements or alternatives to smoking articles typically has been to provide the sensations associated with cigarette, cigar, or pipe smoking, without delivering considerable quantities of incomplete combustion and pyrolysis products. To this end, there have been proposed numerous smoking products, flavor generators, and medicinal inhalers which utilize electrical energy to vaporize or heat a volatile material, or attempt to provide the sensations of cigarette, cigar, or pipe smoking without burning tobacco.

General examples of alternative smoking articles are described in U.S. Pat. No. 3,258,015 to Ellis et al.; U.S. Pat. No. 3,356,094 to Ellis et al.; U.S. Pat. No. 3,516,417 to Moses; U.S. Pat. No. 4,347,855 to Lanzellotti et al.; U.S. Pat. No. 4,340,072 to Bolt et al.; U.S. Pat. No. 4,391,285 to Burnett et al.; U.S. Pat. No. 4,917,121 to Riehl et al.; U.S. Pat. No. 4,924,886 to Litzinger; and U.S. Pat. No. 5,060,676 to Hearn et al. Many of those types of smoking articles have employed a combustible fuel source that is burned to provide an aerosol and/or to heat an aerosol-forming material. See, for example, the background art cited in U.S. Pat. No. 4,714,082 to Banerjee et al. and U.S. Pat. No. 4,771,795 to White et al.; which are incorporated herein by reference in their entireties. See, also, for example, those types of smoking articles described in U.S. Pat. No. 4,756,318 to Clearman et al.; U.S. Pat. No. 4,714,082 to Banerjee et al.; U.S. Pat. No. 4,771,795 to White et al.; U.S. Pat. No. 4,793,365 to Sensabaugh et al.; U.S. Pat. No. 4,917,128 to Clearman et al.; U.S. Pat. No. 4,961,438 to Korte; U.S. Pat. No. 4,966,171 to Serrano et al.; U.S. Pat. No. 4,969,476 to Bale et al.; U.S. Pat. No. 4,991,606 to Serrano et al.; U.S. Pat. No. 5,020,548 to Farrier et al.; U.S. Pat. No. 5,033,483 to Clearman et al.; U.S. Pat. No. 5,040,551 to Schlatter et al.; U.S. Pat. No. 5,050,621 to Creighton et al.; U.S. Pat. No. 5,065,776 to Lawson; U.S. Pat. No. 5,076,296 to Nystrom et al.; U.S. Pat. No. 5,076,297 to Farrier et al.; U.S. Pat. No. 5,099,861 to Clearman et al.; U.S. Pat. No. 5,105,835 to Drewett et al.; U.S. Pat. No. 5,105,837 to Barnes et al.; U.S. Pat. No. 5,115,820 to Hauser et al.; U.S. Pat. No. 5,148,821 to Best et al.; U.S. Pat. No. 5,159,940 to Hayward et al.; U.S. Pat. No. 5,178,167 to Riggs et al.; U.S. Pat. No. 5,183,062 to Clearman et al.; U.S. Pat. No. 5,211,684 to Shannon et al.; U.S. Pat. No. 5,240,014 to Deevi et al.; U.S. Pat. No. 5,240,016 to Nichols et al.; U.S. Pat. No. 5,345,955 to Clearman et al.; U.S. Pat. No. 5,551,451 to Riggs et al.; U.S. Pat. No. 5,595,577 to Bensalem et al.; U.S. Pat. No. 5,819,751 to Barnes et al.; U.S. Pat. No. 6,089,857 to Matsuura et al.; U.S. Pat. No. 6,095,152 to Beven et al; U.S. Pat. No. 6,578,584 Beven; and U.S. Pat. No. 6,730,832 to Dominguez; which are incorporated herein by reference in their entireties. Furthermore, certain types of cigarettes that employ carbonaceous fuel elements have been commercially marketed under the brand names "Premier" and "Eclipse" by R. J. Reynolds Tobacco Company. See, for example, those types of cigarettes described in Chemical and Biological Studies on New Cigarette Prototypes that Heat Instead of Burn Tobacco, R. J. Reynolds Tobacco Company Monograph (1988) and Inhalation Toxicology, 12:5, p. 1-58 (2000). See also US Pat. Pub. No. 2005/0274390 to Banerjee et al., US Pat. Pub. No. 2007/0215167 to Crooks et al., US Pat. Pub. No. 2010/0065075 to Banerjee et al., and US Pat. Pub. No. 2012/0042885 to Stone et al., the disclosures of which are incorporated herein by reference in their entireties.

Certain proposed cigarette-shaped tobacco products purportedly employ tobacco in a form that is not intended to be burned to any significant degree. See, for example, U.S. Pat. No. 4,836,225 to Sudoh; U.S. Pat. No. 4,972,855 to Kuriyama et al.; and U.S. Pat. No. 5,293,883 to Edwards, which are incorporated herein by reference in their entireties. Yet other types of smoking articles, such as those types of smoking articles that generate flavored vapors by subjecting tobacco or processed tobaccos to heat produced from chemical or electrical heat sources, are described in U.S. Pat. No. 4,848,374 to Chard et al.; U.S. Pat. Nos. 4,947,874 and 4,947,875 to Brooks et al.; U.S. Pat. No. 5,060,671 to Counts et al.; U.S. Pat. No. 5,146,934 to Deevi et al.; U.S. Pat. No. 5,224,498 to Deevi; U.S. Pat. No. 5,285,798 to Banerjee et al.; U.S. Pat. No. 5,357,984 to Farrier et al.; U.S. Pat. No. 5,593,792 to Farrier et al.; U.S. Pat. No. 5,369,723 to Counts; U.S. Pat. No. 5,692,525 to Counts et al.; U.S. Pat. No. 5,865,185 to Collins et al.; U.S. Pat. No. 5,878,752 to Adams et al.; U.S. Pat. No. 5,880,439 to Deevi et al.; U.S. Pat. No. 5,915,387 to Baggett et al.; U.S. Pat. No. 5,934,289 to Watkins et al.; U.S. Pat. No. 6,033,623 to Deevi et al.; U.S. Pat. No. 6,053,176 to Adams et al.; U.S. Pat. No. 6,164,287 to White; U.S. Pat. No. 6,289,898 to Fournier et al.; U.S. Pat. No. 6,615,840 to Fournier et al.; U.S. Pat. Pub. No. 2003/0131859 to Li et al.; U.S. Pat. Pub. No. 2005/0016549 to Banerjee et al.; and U.S. Pat. Pub. No. 2006/0185687 to Hearn et al., each of which is incorporated herein by reference in its entirety.

Certain attempts have been made to deliver vapors, sprays or aerosols, such as those possessing or incorporating flavors and/or nicotine. See, for example, the types of devices set forth in U.S. Pat. No. 4,190,046 to Virag; U.S. Pat. No. 4,284,089 to Ray; U.S. Pat. No. 4,635,651 to Jacobs; U.S. Pat. No. 4,735,217 to Gerth et al.; U.S. Pat. No. 4,800,903 to Ray et al.; U.S. Pat. No. 5,388,574 to Ingebrethsen et al.; U.S. Pat. No. 5,799,663 to Gross et al.; U.S. Pat. No.

6,532,965 to Abhulimen et al.; and U.S. Pat. No. 6,598,607 to Adiga et al; and EP 1,618,803 to Hon; which are incorporated herein by reference in their entireties. See also, U.S. Pat. No. 7,117,867 to Cox et al. and the devices set forth on the website, www.e-cig.com, which are incorporated herein by reference in their entireties.

Still further representative cigarettes or smoking articles that have been described and, in some instances, been made commercially available include those described in U.S. Pat. No. 4,922,901 to Brooks et al.; U.S. Pat. No. 5,249,586 to Morgan et al.; U.S. Pat. No. 5,388,594 to Counts et al.; U.S. Pat. No. 5,666,977 to Higgins et al.; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,726,320 to Robinson et al.; U.S. Pat. No. 7,896,006 to Hamano; U.S. Pat. No. 6,772,756 to Shayan; US Pat. Pub. No. 2009/0095311 to Hon; US Pat. Pub. Nos. 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. See also U.S. Pat. No. D657,047 to Minskoff et al. and US Pat. Pub. Nos. 2011/0277757, 2011/0277760, and US 2011/0277764 to Terry et al. Still further examples include electronic cigarette products commercially available under the names ACCORD®; HEATBAR™; HYBRID CIGARETTE®, VEGAS™; E-GAR™; C-GAR™; E-MY-STICK™; IOLITE® Vaporizer, GREEN SMOKE®, BLU™ Cigs, WHITE CLOUD® Cirrus, V2CIGS™, SOUTH BEACH SMOKE™, SMOKETIP®, SMOKE STIK®, NJOY®, LUCI®, Royal Blues, SMART SMOKER®, SMOKE ASSIST®, Knight Sticks, GAMUCCI®, InnoVapor, SMOKING EVERYWHERE®, Crown 7, CHOICE™ NO.7™, VAPORKING®, EPUFFER®, LOGIC™ ecig, VAPOR4LIFE®, NICOTEK®, METRO®, and PREMIUM™.

Smoking articles that employ tobacco substitute materials and smoking articles that employ sources of heat other than burning tobacco cut filler to produce tobacco-flavored vapors or tobacco-flavored visible aerosols have not received widespread commercial success. Articles that produce the taste and sensation of smoking by electrically heating tobacco particularly have suffered from inconsistent release of flavors or other inhalable materials. Electrically heated smoking devices have further been limited in many instances to the requirement of an external heating device that was inconvenient and that detracted from the smoking experience. Accordingly, it can be desirable to provide a smoking article that can provide the sensations of cigarette, cigar, or pipe smoking, that does so without combusting tobacco, that does so without the need of a combustion heat source, and that does so without necessarily delivering considerable quantities of incomplete combustion and pyrolysis products.

BRIEF SUMMARY OF THE INVENTION

The present invention provides a smoking article and methods of use thereof for controllably delivering aerosol precursor components. In particular, disclosed herein is a system that can transport and heat the various chemical compounds present in the aerosol precursor composition under controlled conditions so as to achieve a uniform puff chemistry. In various embodiments, smoking articles as disclosed herein can incorporate certain elements useful to achieve such uniform puff chemistry. For example, a plurality of separate transport elements (e.g., wicks) can be used to transport separate components of the aerosol precursor composition from a reservoir to an aerosolization zone (i.e., at or around a resistive heating element) within the article. Individual transport elements can be formed from different materials (e.g., different fiber types, sintered materials, solid foams, or other porous materials) and can be formed to have different designs (e.g., cross-sectional shape, coatings, woven fibers, non-woven fibers, and bundle size) and thus exhibit different transport properties (e.g., flow rate, wicking properties, or capillary action). A plurality of separate reservoirs can be provided to store separate components of the aerosol precursor composition or separate combinations of components of the aerosol precursor composition. Separate resistive heating elements can be associated with separate components (or combinations of components) of the aerosol precursor composition such that the separate components (or combinations of components) can be heated separately at different temperatures, thermal energy fluxes, or thermal energy inputs.

In some embodiments, a smoking article according to the present disclosure can comprise an aerosolization zone including at least one resistive heating element. The article further can comprise an electrical power source in electrical connection with the at least one resistive heating element. Further, the article can comprise an aerosol precursor composition that is formed of a first component and at least a second separate component. For example, the first component can be a first compound or a mixture of compounds, and the second component can be a second compound or a mixture of compounds. When mixtures of compounds are used, it is possible according to the invention for the two components of the composition to each include one or more of the same chemical compounds so long as they include different ratios. For example, component 1 can comprise compound A and compound B in an A:B ratio of 80:20 (e.g., based on weight or volume), and component 2 can comprise compound A and compound B in a 20:80 ratio (based on weight or volume). Thus, components 1 and 2 are different because they have different ratios of the individual compounds present. Such also can apply where component 1 is formed completely of a single compound while component 2 includes the same compound in mixture with one or more additional compounds. Thus, separate components of the aerosol precursor composition can encompass a variety of embodiments. The aerosol precursor composition specifically is in fluid communication with the aerosolization zone such that the components of the aerosol precursor composition transport from one or more reservoirs to the aerosolization zone, such as via capillary action.

The resistive heating element and the electrical power source in the smoking article can be removably connected. For example, the smoking article can comprise a first unit that is engageable and disengageable with a second unit, the first unit comprising the aerosolization zone including the resistive heating element, and the second unit comprising the electrical power source. The electrical power source can be selected from the group consisting of a battery, a capacitor, and combinations thereof. The smoking article further can comprise one or more control components that actuate or regulate current flow from the electrical power source. Such control components particularly can be located in the second unit with the electrical power source.

The first unit of the smoking article can comprise a distal end that engages the second unit and an opposing, proximate end that includes a mouthpiece with an opening at a proximate end thereof. Further, the first unit can comprise an air flow path opening into the mouthpiece, and the air flow path can provide for passage of aerosol from the aerosolization zone into the mouthpiece. In specific embodiments, the first unit can be disposable. The first unit of the smoking article specifically can comprise the reservoirs that can be used for storing the components of the aerosol precursor composition.

In light of the structure of the smoking article, transport of the aerosol precursor composition to the aerosolization zone can be customized. For example, different combinations of one or more reservoirs, one or more transport elements, and one or more resistive heating elements can be used to form a desired aerosol composition. Beneficially, customization can be further achieved by utilizing specific materials in forming the reservoir(s), using specific materials in forming the transport element(s), and using multiple heating elements operating under the same or different conditions.

When a plurality of transport elements is used, two or more transport elements can transport their respective components of the aerosol precursor composition to the same resistive heating element. In other embodiments, separate transport elements can transport their respective components of the aerosol precursor composition to two or more resistive heating elements. The resistive heating elements can operate at the same or different temperatures (e.g., the operating temperatures differing by about 5° C. or greater). The resistive heating elements can operate under different sets of conditions. In other words, electrical energy can be controllably delivered from the electrical power source to a first resistive heating element via a first control scheme, and electrical energy can be controllably delivered from the electrical power source to one or more further resistive heating elements via one or more, different control schemes. For example, the control schemes can differ in the period of time for which electrical current is delivered to the resistive heating elements. Likewise, the first resistive heating element can function according to a first duty cycle, and one or more further resistive heating elements can function according to one or more further, different duty cycles.

The aerosol precursor composition used in the smoking article can comprise a variety of components. For example, the aerosol precursor composition can comprise a polyhydric alcohol which, in some embodiments, can be selected from the group consisting of glycerin, propylene glycol, and combinations thereof. The aerosol precursor composition also can comprise a medicament, a tobacco component, or a tobacco-derived material. In some embodiments, the aerosol precursor composition can comprise a slurry or solution including tobacco, a tobacco component, or a tobacco-derived material. Further, the aerosol precursor composition can comprise a flavorant.

The reservoir used in the smoking article for storing the aerosol precursor composition can take on a variety of forms. Specifically, the aerosol precursor composition can be coated on, adsorbed by, or absorbed in a substrate or a part thereof (e.g., a reservoir formed of a porous material, such as ceramics and porous carbon (e.g., a foam), or a fibrous material). Such reservoir can be considered to be at least partially saturated with the component of the aerosol precursor composition. The aerosol precursor composition specifically can be provided within a container (i.e., a bottle). Such substrate or bottle can be characterized as a reservoir.

In particular embodiments, a smoking article according to the present disclosure can comprise the following: an aerosolization zone including a resistive heating element; an aerosol precursor composition in liquid form comprising a first component and a second component; a first reservoir comprising a porous material that is at least partially saturated with the first component of the aerosol precursor composition; a second reservoir comprising the second component of the aerosol precursor composition; a first transport element providing fluid communication between the first reservoir and the aerosolization zone; and a second transport element providing fluid communication between the second reservoir and the aerosolization zone. In other embodiments, the second reservoir also can comprise a porous material and can be at least partially saturated with the second component of the aerosol precursor composition. In specific embodiments, the smoking article can comprise a plurality of resistive heating elements. In further embodiments, the smoking article can comprise a first resistive heating element and a second resistive heating element, wherein the first transport element provides fluid communication between the first reservoir and the first resistive heating element, and wherein the second transport element provides fluid communication between the second reservoir and the second resistive heating element. Likewise, the smoking article can comprise a control component adapted to operate the first resistive heating element by a first heating protocol and operate the second resistive heating element by a second, different heating protocol. More specifically, the smoking article can comprise an electrical power source, and the control component can be adapted to control electrical current flow from the power source to the first resistive heating element and the second resistive heating element such that the respective heating elements heat to different temperatures or heat for different lengths of time or both heat to different temperatures and heat for different lengths of time.

In the smoking article, the first transport element can be of a different construction than the second transport element. For example, the first transport element and the second transport element can differ in one or more of cross-sectional shape, material type, surface treatment, and overall dimensions. Further, one or both of the first transport element and the second transport element can be a wick having a defined capillary action. In specific embodiments, the first transport element and the second transport element can both be wicks. Beneficially, the first wick can have a first wicking rate, and the second wick can have a second, different wicking rate. More specifically, a wick can comprise a material selected from the group consisting of fibrous materials, carbon foams, sintered material, capillary tubes, temperature adaptive polymers, and combinations thereof. If desired, the first transport element and the second transport element can be interconnected in the aerosolization zone.

In specific embodiments, the smoking article can comprise a further resistive heating element in substantial contact with one or more of the first reservoir, the second reservoir, the first transport element, and the second transport element. In other embodiments, the smoking article can comprise a control component adapted to operate the further resistive heating element to warm one or more of the first reservoir, the second reservoir, the first transport element, and the second transport element to a temperature that is below a vaporization temperature of the respective component of the aerosol precursor composition. Such heating element can be useful to pre-heat the component of the aerosol precursor composition to alter the characteristics thereof (e.g., reduce viscosity and increase flow rate).

In another aspect, the present invention also provides methods of forming an aerosol in a smoking article from a plurality of aerosol precursor components. In certain embodiments, such method can comprise the following steps: activating a power source within the smoking article to cause flow of electrical current from the power source to a resistive heating element positioned within an aerosolization zone in the smoking article; transporting a first component of an aerosol precursor composition from a first reservoir comprising a porous material that is at least partially saturated with the first component of the aerosol precursor composition to the aerosolization zone via a first transport element; transporting a second component of the aerosol precursor composition from a second reservoir to the aerosolization zone via a second transport element; and heating the aerosol precursor components to form an aerosol. More particularly, the first aerosol precursor component can be transported at a first rate, and the second precursor component can be transported at second, different rate.

In further embodiments, the method can comprise transporting the first component of the aerosol precursor composition from the first reservoir to the resistive heating element in the aerosolization zone and transporting the second component of the aerosol precursor composition from the second reservoir to a second resistive heating element in the aerosolization zone. Further, the method can comprise controlling the flow of electrical current from the power source to the resistive heating element and to the second resistive heating element such that resistive heating element is heated by a first heating protocol and the second resistive heating element is heated by a second, different heating protocol. More particularly, the method can comprise controlling the flow of electrical current from the power source to the resistive heating element and the second resistive heating element such that the respective heating elements heat to different temperatures or heat for different lengths of time or both heat to different temperatures and heat for different lengths of time. In yet further embodiments, the method can comprise heating one or more of the first reservoir, the second reservoir, the first transport element, and the second transport to a temperature that is below a vaporization temperature of the respective component of the aerosol precursor composition.

BRIEF DESCRIPTION OF THE FIGURES

Figure 1:
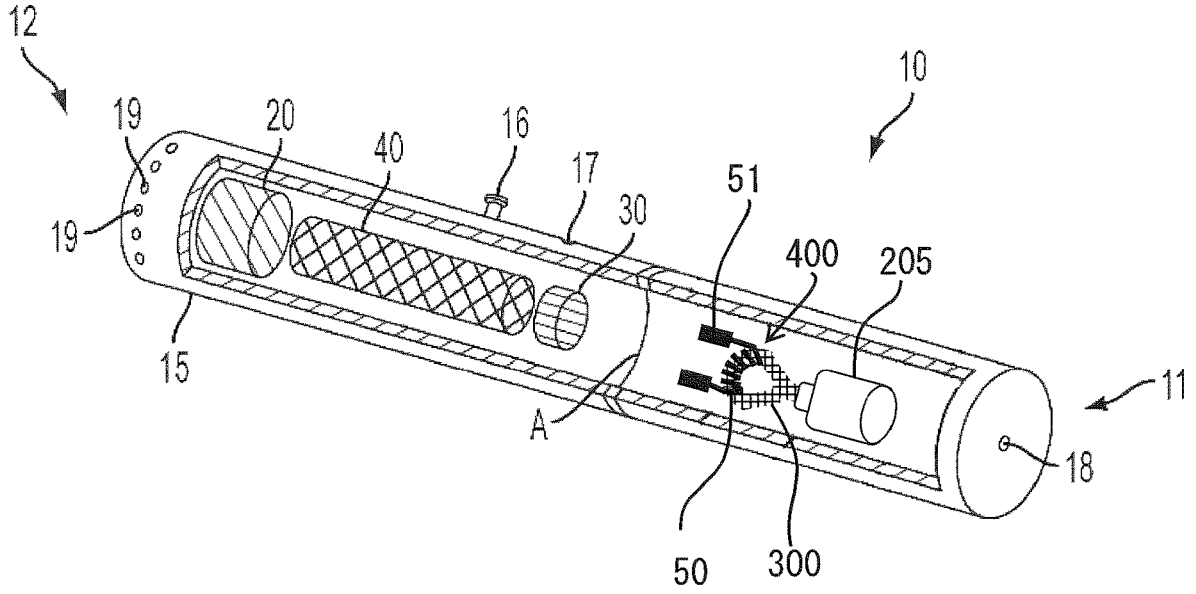
Figure 2:
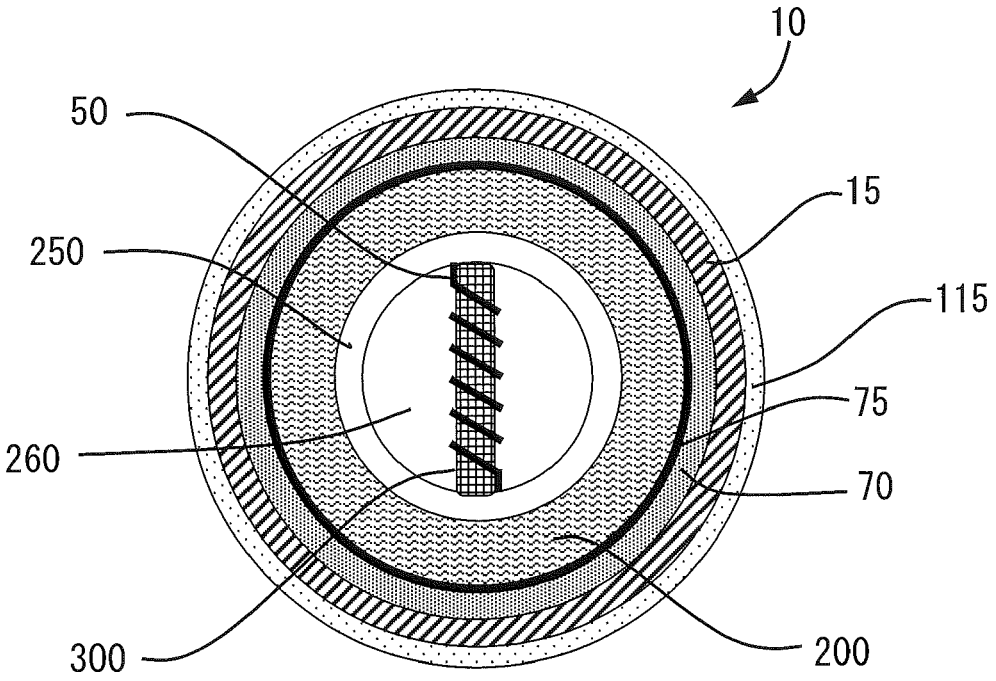
Figure 3:
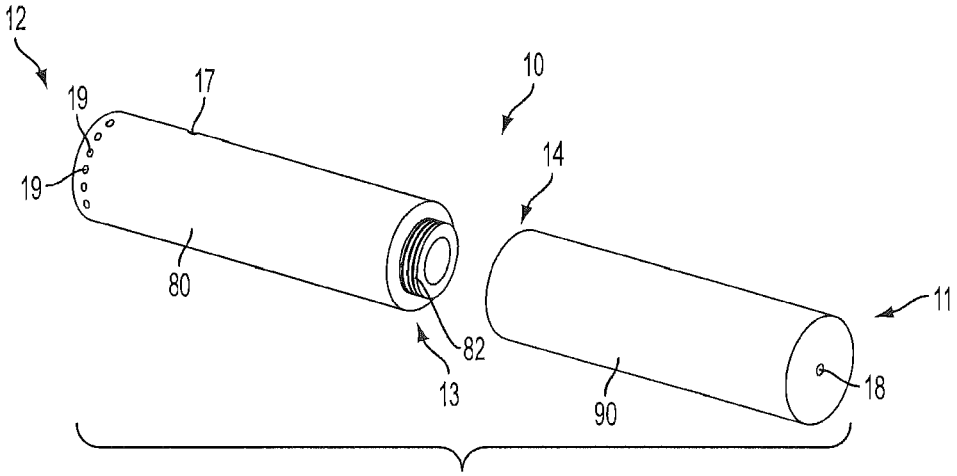
Figure 4:
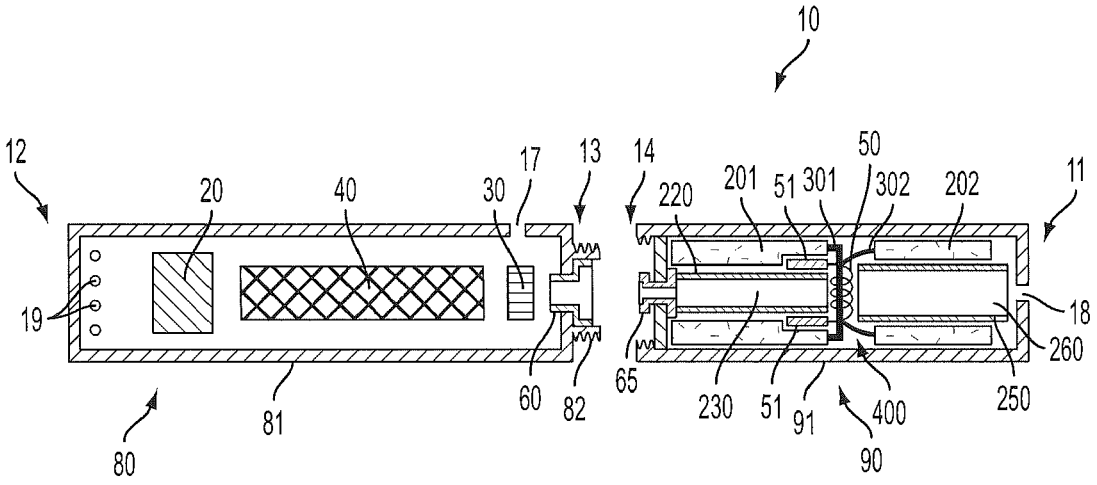
Figure 5:
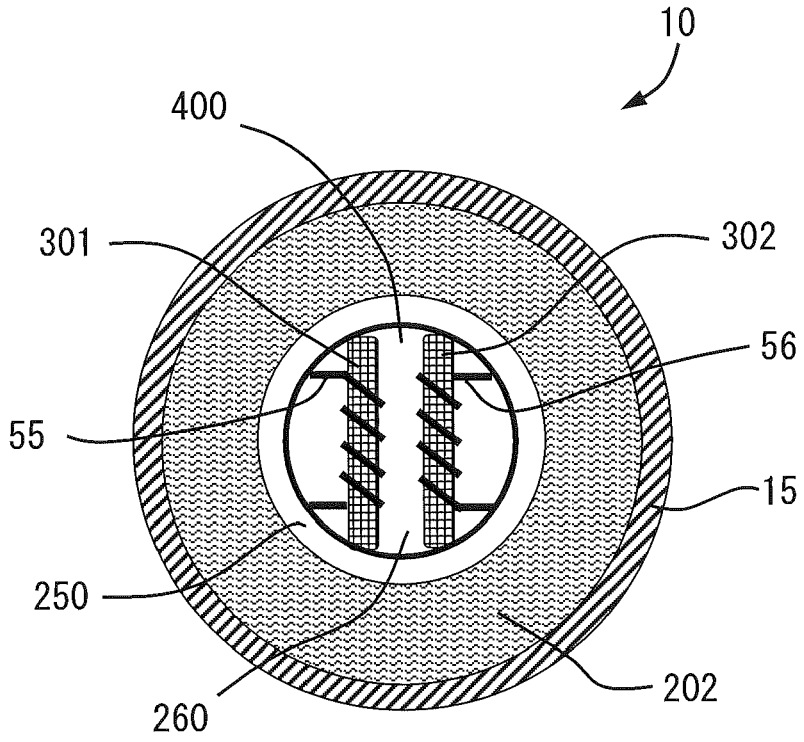

Having thus described the invention in the foregoing general terms, reference will now be made to the accompanying drawings, which are not necessarily drawn to scale, and wherein:

FIG. 1 is a perspective view of an example embodiment of a smoking article according to the invention, wherein a portion of an outer shell of the article is cut away to reveal the interior components thereof;

FIG. 2 is a cross-section of an example embodiment of a smoking article according to the invention, wherein the cross-section is immediately downstream of a transport element surrounded by a resistive heating element;

FIG. 3 is a perspective view of an example embodiment of a smoking article according to the invention, wherein the article comprises a control body and a cartridge that are attachable and detachable therefrom;

FIG. 4 is a longitudinal cross-section of a smoking article according to an example embodiment of the invention; and FIG. 5 is a cross-section of the cartridge portion of a smoking article according to another example embodiment of the invention.

DETAILED DESCRIPTION OF THE INVENTION

The present invention will now be described more fully hereinafter with reference to exemplary embodiments thereof. These exemplary embodiments are described so that this disclosure will be thorough and complete, and will fully convey the scope of the invention to those skilled in the art. Indeed, the invention can be embodied in many different forms and should not be construed as limited to the embodiments set forth herein; rather, these embodiments are provided so that this disclosure will satisfy applicable legal requirements. As used in the specification, and in the appended claims, the singular forms "a", "an", "the", include plural referents unless the context clearly dictates otherwise.

The present invention provides articles that use electrical energy to heat a material (preferably without combusting the material to any significant degree) to form an inhalable substance, the articles being sufficiently compact to be considered "hand-held" devices. In certain embodiments, the articles can particularly be characterized as smoking articles. As used herein, the term is intended to mean an article that provides the taste and/or the sensation (e.g., hand-feel or mouth-feel) of smoking a cigarette, cigar, or pipe without substantial combustion of any component of the article. The term smoking article does not necessarily indicate that, in operation, the article produces smoke in the sense of the by-product of combustion or pyrolysis. Rather, smoking relates to the physical action of an individual in using the article—e.g., holding the article, drawing on one end of the article, and inhaling from the article. In further embodiments, the inventive articles can be characterized as being vapor-producing articles, aerosolization articles, or medicament delivery articles. Thus, the articles can be arranged so as to provide one or more substances in an inhalable state. In other embodiments, the inhalable substance can be substantially in the form of a vapor (i.e., a substance that is in the gas phase at a temperature lower than its critical point). In other embodiments, the inhalable substance can be in the form of an aerosol (i.e., a suspension of fine solid particles or liquid droplets in a gas). The physical form of the inhalable substance is not necessarily limited by the nature of the inventive articles but rather can depend upon the nature of the medium and the inhalable substance itself as to whether it exists in a vapor state or an aerosol state. In some embodiments, the terms can be interchangeable. Thus, for simplicity, these terms as used to describe the invention are understood to be interchangeable unless stated otherwise.

In one aspect, the present invention provides a smoking article. The smoking article generally can include a number of components provided within an elongated body, which can be a single, unitary shell or which can be formed of two or more separable pieces. For example, a smoking article according to one embodiment can comprise a shell (i.e., the elongated body) that can be substantially tubular in shape, such as resembling the shape of a conventional cigarette or cigar. Within the shell can reside all of the components of the smoking article. In other embodiments, a smoking article can comprise two shells that are joined and are separable. For example, a control body can comprise a shell containing one or more reusable components and having an end that removably attaches to a cartridge. The cartridge can comprise a shell containing one or more disposable components and having an end that removably attaches to the control body. More specific arrangements of components within the single shell or within the separable control body and cartridge are evident in light of the further disclosure provided herein.

Smoking articles useful according to the invention particularly can comprise some combination of a power source (i.e., an electrical power source), one or more control components (e.g., to control/actuate/regulate flow of power from the power source to one or more further components of the article), a heater component, and an aerosol precursor component. The smoking article further can include a defined air flow path through the article such that aerosol generated by the article can be withdrawn therefrom by a user drawing on the article. Alignment of the components within the article can vary. In specific embodiments, the aerosol precursor component can be located near an end of the article that is proximal to the mouth of a user so as to maximize aerosol delivery to the user. Other configurations, however, are not excluded. Generally, the heater component can be positioned sufficiently near that aerosol precursor component so that heat from the heater component can volatilize the aerosol precursor (as well as one or more flavorants, medicaments, or the like that can likewise be provided for delivery to a user) and form an aerosol for delivery to the user. When the heating member heats the aerosol precursor component, an aerosol (alone or including a further inhalable substance) is formed, released, or generated in a physical form suitable for inhalation by a consumer. It should be noted that the foregoing terms are meant to be interchangeable. As such, the terms release, generate, and form can be interchangeable, the terms releasing, generating, and forming can be interchangeable, the terms releases, forms, and generates can be interchangeable, and the terms released, formed, and generated can be interchangeable. Specifically, an inhalable substance is released as a vapor or aerosol or mixture thereof.

A smoking article according to the invention generally can include an electrical power source (or electrical power sources) to provide current flow sufficient to provide various functionalities to the article, such as resistive heating, powering of indicators, and the like. The power source for the inventive smoking article can take on various embodiments. Preferably, the power source is able to deliver sufficient power to rapidly heat the heating member to provide for aerosol formation and power the article through use for the desired duration of time. The power source preferably is sized to fit conveniently within the article. Examples of useful power sources include lithium ion batteries that preferably are rechargeable (e.g., a rechargeable lithium-manganese dioxide battery). In particular, lithium polymer batteries can be used. Other types of batteries—e.g., N50-AAA CADNICA nickel-cadmium cells—can also be used. Even further examples of batteries that can be used according to the invention are described in US Pub. App. No. 2010/0028766, the disclosure of which is incorporated herein by reference in its entirety. Thin film batteries can be used in certain embodiments of the invention. Any of these batteries or combinations thereof can be used in the power source, but rechargeable batteries are preferred because of cost and disposal considerations associated with disposable batteries. In embodiments wherein disposable batteries are provided, the smoking article can include access for removal and replacement of the battery. Alternatively, in embodiments where rechargeable batteries are used, the smoking article can comprise charging contacts for interaction with corresponding contacts in a conventional recharging unit deriving power from a standard 120-volt AC wall outlet, or other sources such as an automobile electrical system or a separate portable power supply, including USB connections. Means for recharging the battery can be provided in a portable charging case that can include, for example, a relatively larger battery unit that can provide multiple charges for the relatively smaller batteries present in the smoking article. The article further can include components for providing a non-contact inductive recharging system such that the article can be charged without being physically connected to an external power source. Thus, the article can include components to facilitate transfer of energy from an electromagnetic field to the rechargeable battery within the article.

In further embodiments, the power source also can comprise a capacitor. Capacitors are capable of discharging more quickly than batteries and can be charged between puffs, allowing the battery to discharge into the capacitor at a lower rate than if it were used to power the heating member directly. For example, a supercapacitor—i.e., an electric double-layer capacitor (EDLC)—can be used separate from or in combination with a battery. When used alone, the supercapacitor can be recharged before each use of the article. Thus, the invention also can include a charger component that can be attached to the smoking article between uses to replenish the supercapacitor.

The smoking article can further include a variety of power management software, hardware, and/or other electronic control components. For example, such software, hardware, and/or electronic controls can include carrying out charging of the battery, detecting the battery charge and discharge status, performing power save operations, preventing unintentional or over-discharge of the battery, puff counting, puff delimiting, puff duration, identifying cartridge status, temperature control, or the like.

A "controller" or "control component" according to the present invention can encompass a variety of elements useful in the present smoking article. Moreover, a smoking article according to the invention can include one, two, or even more control components that can be combined into a unitary element or that can be present at separate locations within the smoking article, and individual control components can be utilized for carrying out different control aspects. For example, a smoking article can include a control component that is integral to or otherwise combined with a battery so as to control power discharge from the battery. The smoking article separately can include a control component that controls other aspects of the article. Alternatively, a single controller can be provided that carries out multiple control aspects or all control aspects of the article. Likewise, a sensor (e.g., a puff sensor) used in the article can include a control component that controls the actuation of power discharge from the power source in response to a stimulus. The smoking article separately can include a control component that controls other aspects of the article. Alternatively, a single controller can be provided in or otherwise associated with the sensor for carrying out multiple control aspects or all control aspects of the article. Thus, it can be seen that a variety of combinations of controllers can be combined in the present smoking article to provide the desired level of control of all aspects of the device.

The smoking article also can comprise one or more controller components useful for controlling flow of electrical energy from the power source to further components of the article, such as to a resistive heating element. Specifically, the article can comprise a control component that actuates current flow from the power source, such as to the resistive heating element. For example, in some embodiments, the article can include a pushbutton that can be linked to a control circuit for manual control of power flow. For example, a consumer can use the pushbutton to turn on the article and/or to actuate current flow into the resistive heating element. Multiple buttons can be provided for manual performance of powering the article on and off, and for activating heating for aerosol generation. One or more pushbuttons present can be substantially flush with an outer surface of the smoking article.

Instead of (or in addition to) the pushbutton, the inventive article can include one or more control components responsive to the consumer's drawing on the article (i.e., puff-actuated heating). For example, the article can include a switch that is sensitive either to pressure changes or air flow changes as the consumer draws on the article (i.e., a puff-actuated switch). Other suitable current actuation/deactuation mechanisms can include a temperature actuated on/off switch or a lip pressure actuated switch. An exemplary mechanism that can provide such puff-actuation capability includes a Model 163PC01D36 silicon sensor, manufactured by the MicroSwitch division of Honeywell, Inc., Freeport, Ill. With such sensor, the resistive heating element can be activated rapidly by a change in pressure when the consumer draws on the article. In addition, flow sensing devices, such as those using hot-wire anemometry principles, can be used to cause the energizing of the resistive heating element sufficiently rapidly after sensing a change in air flow. A further puff actuated switch that can be used is a pressure differential switch, such as Model No. MPL-502-V, range A, from Micro Pneumatic Logic, Inc., Ft. Lauderdale, Fla. Another suitable puff actuated mechanism is a sensitive pressure transducer (e.g., equipped with an amplifier or gain stage) which is in turn coupled with a comparator for detecting a predetermined threshold pressure. Yet another suitable puff actuated mechanism is a vane which is deflected by airflow, the motion of which vane is detected by a movement sensing means. Yet another suitable actuation mechanism is a piezoelectric switch. Also useful is a suitably connected Honeywell MicroSwitch Microbridge Airflow Sensor, Part No. AWM 2100V from MicroSwitch Division of Honeywell, Inc., Freeport, Ill. Further examples of demand-operated electrical switches that can be employed in a heating circuit according to the present invention are described in U.S. Pat. No. 4,735,217 to Gerth et al., which is incorporated herein by reference in its entirety. Other suitable differential switches, analog pressure sensors, flow rate sensors, or the like, will be apparent to the skilled artisan with the knowledge of the present disclosure. A pressure-sensing tube or other passage providing fluid connection between the puff actuated switch and an air flow passage within the smoking article can be included so that pressure changes during draw are readily identified by the switch.

Capacitive sensing components in particular can be incorporated into the device in a variety of manners to allow for diverse types of "power-up" and/or "power-down" for one or more components of the device. Capacitive sensing can include the use of any sensor incorporating technology based on capacitive coupling including, but not limited to, sensors that detect and/or measure proximity, position or displacement, humidity, fluid level, pressure, temperature, or acceleration. Capacitive sensing can arise from electronic components providing for surface capacitance, projected capacitance, mutual capacitance, or self capacitance. Capacitive sensors generally can detect anything that is conductive or has a dielectric different than that of air. Capacitive sensors, for example, can replace mechanical buttons (i.e., the push-button referenced above) with capacitive alternatives. Thus, one specific application of capacitive sensing according to the invention is a touch capacitive sensor. For example, a touch pad can be present on the smoking article that allows the user to input a variety of commands. Most basically, the touch pad can provide for powering the heating element much in the same manner as a push button, as already described above. In other embodiments, capacitive sensing can be applied near the mouthend of the smoking article such that the pressure of the lips on the smoking article to draw on the article can signal the device to provide power to the heating element. In addition to touch capacitance sensors, motion capacitance sensors, liquid capacitance sensors, and accelerometers can be utilized according to the invention to elicit a variety of response from the smoking article. Further, photoelectric sensors also can be incorporated into the inventive smoking article.

Sensors (or control components generally) utilized in the present articles can expressly signal for power flow to the heating element so as to heat the aerosol precursor composition and form a vapor or aerosol for inhalation by a user. Such control components can be adapted to operate a resistive heating element by a defined heating protocol (e.g., temperature achieved, duration of heating, etc.). Specifically, the control component can be adapted to control electrical current flow from the power source so as to achieve the defined heating protocol.

Sensors also can provide further functions. For example, a "wake-up" sensor can be included. In particular embodiments, a smoking article can be packaged in a "sleep" mode such that power from the power source cannot be delivered to the heating element (or other components of the article if desired). The smoking article can include a sensor, such as a photoelectric sensor or a pull-tab activated sensor or even a capacitive sensor, such that after the smoking article is unpackaged, activation of the sensor moves the article from the sleep mode to a working mode wherein the article can be used as otherwise described herein. For example, the smoking article can be packaged such that light is substantially prevented from reaching the smoking article. A photoelectric sensor on the article then would function to detect when the article is removed from the packaging—i.e., is subject to ambient lighting—and transition the article from the sleep mode to a working mode. Likewise, the sensor can function such that when the article is again protected from ambient lighting—e.g., placed in a carrying case or storage case—the article reverts to the sleep mode as a safety measure. Other sensing methods providing similar function likewise can be utilized according to the invention.

When the consumer draws on the mouth end of the smoking article, the current actuation means can permit unrestricted or uninterrupted flow of current through the resistive heating member to generate heat rapidly. Because of the rapid heating, it can be useful to include current regulating components to (i) regulate current flow through the heating member to control heating of the resistive element and the temperature experienced thereby, and (ii) prevent overheating and degradation of the resistive heating element or one or more components carrying the aerosol precursor composition and/or other flavors or inhalable materials.

The current regulating circuit particularly can be time based. Specifically, such a circuit includes a means for permitting uninterrupted current flow through the heating element for an initial time period during draw, and a timer means for subsequently regulating current flow until draw is completed. For example, the subsequent regulation can include the rapid on-off switching of current flow (e.g., on the order of about every 1 to 50 milliseconds) to maintain the heating element within the desired temperature range. Further, regulation can comprise simply allowing uninterrupted current flow until the desired temperature is achieved then turning off the current flow completely. The heating member can be reactivated by the consumer initiating another puff on the article (or manually actuating the pushbutton, depending upon the specific switch embodiment employed for activating the heater). Alternatively, the subsequent regulation can involve the modulation of current flow through the heating element to maintain the heating element within a desired temperature range. In some embodiments, so as to release the desired dosing of the inhalable substance, the heating member can be energized for a duration of about 0.2 second to about 5.0 seconds, about 0.3 second to about 4.5 seconds, about 0.5 second to about 4.0 seconds, about 0.5 second to about 3.5 seconds, or about 0.6 second to about 3.0 seconds. One exemplary time-based current regulating circuit can include a transistor, a timer, a comparator, and a capacitor. Suitable transistors, timers, comparators, and capacitors are commercially available and will be apparent to the skilled artisan. Exemplary timers are those available from NEC Electronics as C-1555C and from General Electric Intersil, Inc. as ICM7555, as well as various other sizes and configurations of so-called "555 Timers". An exemplary comparator is available from National Semiconductor as LM311. Further description of such time-based current regulating circuits and other control components that can be useful in the present smoking article are provided in U.S. Pat. Nos. 4,922,901, 4,947,874, and 4,947,875, all to Brooks et al., all of which are incorporated herein by reference in their entireties.

The control components particularly can be configured to closely control the amount of heat provided to the resistive heating element. In some embodiments, the current regulating component can function to stop current flow to the resistive heating element once a defined temperature has been achieved. Such defined temperature can be in a range that is substantially high enough to volatilize the aerosol precursor composition and any further inhalable substances and provide an amount of aerosol equivalent to a typical puff on a conventional cigarette, as otherwise discussed herein. While the heat needed to volatilize the aerosol precursor composition in a sufficient volume to provide a desired volume for a single puff can vary, it can be particularly useful for the heating member to heat to a temperature of about 120° C. or greater, about 130° C. or greater, about 140° C. or greater, or about 160° C. In some embodiments, in order to volatilize an appropriate amount of the aerosol precursor composition, the heating temperature can be about 180° C. or greater, about 200° C. or greater, about 300° C. or greater, or about 350° C. or greater. In further embodiments, the defined temperature for aerosol formation can be about 120° C. to about 350° C., about 140° C. to about 300° C., or about 150° C. to about 250° C. It can be particularly desirable, however, to avoid heating to temperatures substantially in excess of about 550° C. in order to avoid degradation and/or excessive, premature volatilization of the aerosol precursor composition and/or other construction materials. In some embodiments, a plurality of heating elements can be used, and the control components can be adapted to operate the heating elements under the same or different conditions. For example, two or more heating elements can be controlled so as to heat to different temperatures, heat for different lengths of time, or both. Heating specifically should be at a sufficiently low temperature and for a sufficiently short time so as to avoid degradation and/or significant combustion (preferably any combustion) of any component of the article. The duration of heating can be controlled by a number of factors, as discussed in greater detail hereinbelow. Heating temperature and duration can depend upon the desired volume of aerosol and ambient air that is desired to be drawn through the article. The duration, however, can be varied depending upon the heating rate of the resistive heating element, as the article can be configured such that the resistive heating element is energized only until a desired temperature is reached. Alternatively, duration of heating can be coupled to the duration of a puff on the article by a consumer. The heating protocol further can depend upon the specific component of the aerosol precursor composition being heated. For example, more volatile components can be heated to lower temperatures or heated for lesser duration of time. Similarly, components forming a lesser concentration of the desired aerosol composition can be heated for a lesser duration of time so as to release a lower concentration of the respective component. Generally, the temperature and time of heating will be controlled by one or more components contained in the control housing, as noted above.

The current regulating component likewise can cycle the current to the resistive heating element off and on once a defined temperature has been achieved so as to maintain the defined temperature for a defined period of time. This tenet can be applied to a plurality of heaters at a variety of different temperatures. Such rapid on-off cycling can be as already discussed above, and the defined temperature can be an aerosol generating temperature as noted above.

Still further, the current regulating component can cycle the current to the one or more resistive heating elements off and on to maintain a first temperature that is below an aerosol forming temperature and then allow an increased current flow in response to a current actuation control component so as to achieve a second temperature that is greater than the first temperature and that is an aerosol forming temperature. Such controlling can improve the response time of the article for aerosol formation such that aerosol formation begins almost instantaneously upon initiation of a puff by a consumer. In some embodiments, the first temperature (which can be characterized as a standby temperature) can be only slightly less than the aerosol forming temperature defined above. Specifically, the standby temperature can be about 50° C. to about 150° C., about 70° C. to about 140° C., about 80° C. to about 120° C., or about 90° C. to about 110° C.

In light of the foregoing, it can be seen that a variety of mechanisms can be employed to facilitate actuation/deactuation of current to the one or more resistive heating elements and to other components of the smoking article. Specifically the article can comprise a component that regulates a previously initiated current flow from the electrical power source to the resistive heating element. For example, the inventive article can comprise a timer (i.e., a time-based component) for regulating current flow in the article (such as during draw by a consumer). The article further can comprise a timer responsive switch that enables and disables current flow to the resistive heating element. Current flow regulation also can comprise use of a capacitor and components for charging and discharging the capacitor at a defined rate (e.g., a rate that approximates a rate at which the heating member heats and cools). Current flow specifically can be regulated such that there is uninterrupted current flow through the heating member for an initial time period during draw, but the current flow can be turned off or cycled alternately off and on after the initial time period until draw is completed. Such cycling can be controlled by a timer, as discussed above, which can generate a preset switching cycle. In specific embodiments, the timer can generate a periodic digital wave form. The flow during the initial time period further can be regulated by use of a comparator that compares a first voltage at a first input to a threshold voltage at a threshold input and generates an output signal when the first voltage is equal to the threshold voltage, which enables the timer. Such embodiments further can include components for generating the threshold voltage at the threshold input and components for generating the threshold voltage at the first input upon passage of the initial time period.

In addition to the above control elements, the smoking article also can comprise one or more indicators. Such indicators can be lights (e.g., light emitting diodes) that can provide indication of multiple aspects of use of the inventive article. For example, a series of lights can correspond to the number of puffs for a given cartridge of the smoking article. Specifically, the lights can become lit with each puff indicating to a consumer that the cartridge was completely used when all lights were lit. Alternatively, all lights can be lit upon the initial loading of the cartridge, and a light can turn off with each puff indicating to a consumer that the cartridge was completely used when all lights were off. In still other embodiments, only a single indicator can be present, and lighting thereof can indicate that current is flowing to the resistive heating element and the article is actively heating. This can ensure that a consumer does not unknowingly leave an article unattended in an actively heating mode. Still further, one or more indicators can be provided as an indicator of battery status—e.g., battery charge, low battery, battery charging, or the like. Further, LED indicators can be positioned at the distal end of the smoking article to simulate color changes seen when a conventional cigarette is lit and drawn on by a user. Although the indicators are described above in relation to visual indicators in an on/off method, other indices of operation also are encompassed. For example, visual indicators also can include changes in light color or intensity to show progression of the smoking experience. Tactile indicators and audio indicators similarly are encompassed by the invention. Moreover, combinations of such indicators also can be used in a single article.

A smoking article according to the invention further can comprise a heating member that heats an aerosol precursor component to produce an aerosol for inhalation by a user. In various embodiments, the heating member can be formed of a material that provides resistive heating when an electrical current is applied thereto. Preferably, the resistive heating element exhibits an electrical resistance making the resistive heating element useful for providing a sufficient quantity of heat when electrical current flows therethrough.

Electrically conductive materials useful as resistive heating elements can be those having low mass, low density, and moderate resistivity and that are thermally stable at the temperatures experienced during use. Useful heating elements heat and cool rapidly, and thus provide for the efficient use of energy. Rapid heating of the element can be beneficial to provide almost immediate volatilization of an aerosol precursor composition in proximity thereto. Rapid cooling prevents substantial volatilization (and hence waste) of the aerosol precursor composition during periods when aerosol formation is not desired. Such heating elements also permit relatively precise control of the temperature range experienced by the aerosol precursor composition, especially when time based current control is employed. Useful electrically conductive materials preferably are thermally stable and chemically non-reactive with the materials being heated (e.g., aerosol precursor compositions and other inhalable substance materials) so as not to adversely affect the flavor or content of the aerosol or vapor that is produced. Exemplary, non-limiting, materials that can be used as the electrically conductive material include carbon, graphite, carbon/graphite composites, metals, metallic and non-metallic carbides, nitrides, silicides, inter-metallic compounds, cermets, metal alloys, and metal foils. In particular, refractory materials can be useful. Various, different materials can be mixed to achieve the desired properties of resistivity, mass, and thermal conductivity. In specific embodiments, metals that can be utilized include, for example, nickel, chromium, alloys of nickel and chromium (e.g., nichrome), and steel. Materials that can be useful for providing resistive heating are described in U.S. Pat. No. 5,060,671 to Counts et al.; U.S. Pat. No. 5,093,894 to Deevi et al.; U.S. Pat. No. 5,224,498 to Deevi et al.; U.S. Pat. No. 5,228,460 to Sprinkel Jr., et al.; 5,322,075 to Deevi et al.; U.S. Pat. No. 5,353,813 to Deevi et al.; U.S. Pat. No. 5,468,936 to Deevi et al.; U.S. Pat. No. 5,498,850 to Das; U.S. Pat. No. 5,659,656 to Das; U.S. Pat. No. 5,498,855 to Deevi et al.; U.S. Pat. No. 5,530,225 to Hajaligol; U.S. Pat. No. 5,665,262 to Hajaligol; U.S. Pat. No. 5,573,692 to Das et al.; and U.S. Pat. No. 5,591,368 to Fleischhauer et al., the disclosures of which are incorporated herein by reference in their entireties.

The resistive heating element can be provided in a variety forms, such as in the form of a foil, a foam, discs, spirals, fibers, wires, films, yarns, strips, ribbons, or cylinders, as well as irregular shapes of varying dimensions. In some embodiments, a resistive heating element according to the present invention can be a conductive substrate, such as described in co-pending U.S. patent application Ser. No. 13/432,406, filed Mar. 28, 2012, the disclosure of which is incorporated herein by reference in its entirety.

Beneficially, the resistive heating element can be provided in a form that enables the heating element to be positioned in intimate contact with or in close proximity to the aerosol precursor composition, or one or more components thereof. In other embodiments, the resistive heating element can be provided in a form such that the aerosol precursor composition can be transported to the resistive heating element for aerosolization. Such transport can be via a variety of means. For example, transport of components for aerosolization can comprise wicking (i.e., transport via capillary action), diffusion, thermally driven diffusion, surface diffusion, passive flow, and active pumping or mechanically driven flow. In some embodiments, one or more valves can be utilized to control transport of the components for aerosolization. As such, the components for aerosolization (including aerosol formers and other inhalable materials) can be provided in liquid form in one or more reservoirs positioned sufficiently away from the resistive heating element to prevent premature aerosolization, but positioned sufficiently close to the resistive heating element to facilitate transport of the aerosol precursor composition, in the desired amount, to the resistive heating element for aerosolization.

In certain embodiments, a smoking article according to the present invention can include tobacco, a tobacco component, or a tobacco-derived material (i.e., a material that is found naturally in tobacco that can be isolated directly from the tobacco or synthetically prepared). The tobacco that is employed can include, or can be derived from, tobaccos such as flue-cured tobacco, burley tobacco, Oriental tobacco, Maryland tobacco, dark tobacco, dark-fired tobacco and *Rustica* tobacco, as well as other rare or specialty tobaccos, or blends thereof. Various representative tobacco types, processed types of tobaccos, and types of tobacco blends are set forth in U.S. Pat. No. 4,836,224 to Lawson et al.; U.S. Pat. No. 4,924,888 to Perfetti et al.; U.S. Pat. No. 5,056,537 to Brown et al.; U.S. Pat. No. 5,159,942 to Brinkley et al.; U.S. Pat. No. 5,220,930 to Gentry; U.S. Pat. No. 5,360,023 to Blakley et al.; U.S. Pat. No. 6,701,936 to Shafer et al.; U.S. Pat. No. 6,730,832 to Dominguez et al., U.S. Pat. No. 7,011,096 to Li et al.; U.S. Pat. No. 7,017,585 to Li et al.; U.S. Pat. No. 7,025,066 to Lawson et al.; US Pat. App. Pub. No. 2004/0255965 to Perfetti et al.; PCT Pub. WO 02/37990 to Bereman; and Bombick et al., *Fund. Appl. Toxicol.,* 39, p. 11-17 (1997); the disclosures of which are incorporated herein by reference in their entireties. Descriptions of various types of tobaccos, growing practices, harvesting practices, and curing practices are set forth in Tobacco Production, Chemistry and Technology, Davis et al. (Eds.) (1999).

The smoking article can incorporate tobacco additives of the type that are traditionally used for the manufacture of tobacco products. Those additives can include the types of materials used to enhance the flavor and aroma of tobaccos used for the production of cigars, cigarettes, pipes, and the like. For example, those additives can include various cigarette casing and/or top dressing components. See, for example, U.S. Pat. No. 3,419,015 to Wochnowski; U.S. Pat. No. 4,054,145 to Berndt et al.; U.S. Pat. No. 4,887,619 to Burcham, Jr. et al.; U.S. Pat. No. 5,022,416 to Watson; U.S. Pat. No. 5,103,842 to Strang et al.; and U.S. Pat. No. 5,711,320 to Martin; the disclosures of which are incorporated herein by reference in their entireties. Preferred casing materials include water, sugars and syrups (e.g., sucrose, glucose and high fructose corn syrup), humectants (e.g. glycerin or propylene glycol), and flavoring agents (e.g., cocoa and licorice). Those added components also include top dressing materials (e.g., flavoring materials, such as menthol). See, for example, U.S. Pat. No. 4,449,541 to Mays et al., the disclosure of which is incorporated herein by reference in its entirety. The selection of particular casing and top dressing components is dependent upon factors such as the sensory characteristics that are desired, and the selection and use of those components will be readily apparent to those skilled in the art of cigarette design and manufacture. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. Further materials that can be added include those disclosed in U.S. Pat. No. 4,830,028 to Lawson et al. and US Pat. Pub. No. 2008/0245377 to Marshall et al., the disclosures of which are incorporated herein by reference in their entireties.

Various manners and methods for incorporating tobacco into smoking articles, and particularly smoking articles that are designed so as to not purposefully burn virtually all of the tobacco within those smoking articles, are set forth in U.S. Pat. No. 4,947,874 to Brooks et al.; U.S. Pat. No. 7,647,932 to Cantrell et al., US Pat. App. Pub. No. 2005/0016549 to Banerjee et al.; and US Pat. App. Pub. No. 2007/0215167 to Crooks et al.; the disclosures of which are incorporated herein by reference in their entireties.

The aerosol precursor or vapor precursor composition can comprise one or more different components. For example, the aerosol precursor can include a polyhydric alcohol (e.g., glycerin, propylene glycol, or a mixture thereof). Representative types of further aerosol precursor compositions are set forth in U.S. Pat. No. 4,793,365 to Sensabaugh, Jr. et al.; U.S. Pat. No. 5,101,839 to Jakob et al.; PCT WO 98/57556 to Biggs et al.; and Chemical and Biological Studies on New Cigarette Prototypes that Heat Instead of Burn Tobacco, R. J. Reynolds Tobacco Company Monograph (1988); the disclosures of which are incorporated herein by reference. In some embodiments, an aerosol precursor composition can produce a visible aerosol upon the application of sufficient heat thereto (and cooling with air, if necessary), and such aerosol precursor composition can produce an aerosol that can be considered to be "smoke-like." In some embodiments, however, the aerosol precursor component can be heated to form an aerosol that is substantially invisible to the naked eye and can be identified primarily by the flavor and/or aroma and/or texture apparent to the consumer. Thus, the term "aerosol precursor composition" can broadly encompass compositions (or components thereof) that produce a visible aerosol as well as compositions (or components thereof) that produce an aerosol that is identifiably by further characteristics (e.g., other than visibility). For example, a polyhydric alcohol can be considered to be an aerosol precursor that can produce a visible aerosol. Other components, such as some flavors or medicaments, can be considered to be an aerosol precursor that can produce an aerosol that is identifiable by further characteristics. An exemplary aerosol precursor composition can be chemically simple, relative to the chemical nature of the smoke produced by burning tobacco. If desired, aerosol precursor compositions can include other liquid materials, such as water. For example, aerosol precursor compositions can incorporate mixtures of glycerin and water, or mixtures of propylene glycol and water, or mixtures of propylene glycol and glycerin, or mixtures of propylene glycol, glycerin, and water. Exemplary aerosol precursor compositions also include those types of materials incorporated within devices available through Atlanta Imports Inc., Acworth, Ga., USA., as an electronic cigar having the brand name E-CIG, which can be employed using associated Smoking Cartridges Type C1a, C2a, C3a, C4a, C1b, C2b, C3b and C4b; and as Ruyan Atomizing Electronic Pipe and Ruyan Atomizing Electronic Cigarette from Ruyan SBT Technology and Development Co., Ltd., Beijing, China.

Further tobacco materials, such as a tobacco aroma oil, a tobacco essence, a spray dried tobacco extract, a freeze dried tobacco extract, tobacco dust, or the like can be combined with the vapor precursor or aerosol precursor composition. As used herein, the term "tobacco extract" means components separated from, removed from, or derived from, tobacco using tobacco extraction processing conditions and techniques. Purified extracts (including extracts from other botanicals) particularly can be used. Typically, tobacco extracts are obtained using solvents, such as solvents having an aqueous nature (e.g., water) or organic solvents (e.g., alcohols, such as ethanol or alkanes, such as hexane). As such, extracted tobacco components are removed from tobacco and separated from the unextracted tobacco components; and for extracted tobacco components that are present within a solvent, (i) the solvent can be removed from the extracted tobacco components, or (ii) the mixture of extracted tobacco components and solvent can be used as such. For example, tobacco can be subjected to extraction conditions using water as a solvent; the resulting aqueous extract of tobacco then is separated from the water insoluble pulp; and then (i) the mixture of aqueous extract of tobacco within water can be used as such, or (ii) substantial amounts of the water can be removed from extracted tobacco components (e.g., using spray drying or freeze drying techniques) in order to provide a tobacco extract in powder form. Preferred tobacco extracts incorporate numerous components that are separated from, removed from, or derived from, tobacco; and are not obtained using tobacco extraction processes conditions that are highly selective to a single component (e.g., preferred extracts are not high nicotine content extracts, or extracts that can be characterized as relatively pure nicotine compositions). As such, exemplary preferred tobacco extracts possess less than 45 percent nicotine, often less than 35 percent nicotine, and frequently less than 25 percent nicotine, on the basis of the total extract weight with solvent removed (e.g., on a dry weight basis when the solvent is water). In addition, highly preferred tobacco extracts are highly aromatic and flavorful, and hence introduce desirable sensory characteristics to the aerosol produced by the smoking articles incorporating those extracts. Exemplary types of tobacco extracts, tobacco essences, solvents, tobacco extraction processing conditions and techniques, and tobacco extract collection and isolation procedures, are set forth in Australia Pat. No. 276,250 to Schachner; U.S. Pat. No. 2,805,669 to Meriro; U.S. Pat. No. 3,316,919 to Green et al.; U.S. Pat. No. 3,398,754 to Tughan; U.S. Pat. No. 3,424,171 to Rooker; U.S. Pat. No. 3,476,118 to Luttich; U.S. Pat. No. 4,150,677 to Osborne; U.S. Pat. No. 4,131,117 to Kite; U.S. Pat. No. 4,506,682 to Muller; U.S. Pat. No. 4,986,286 to Roberts et al.; U.S. Pat. No. 5,005,593 to Fagg; U.S. Pat. No. 5,065,775 to Fagg; U.S. Pat. No. 5,060,669 to White et al.; U.S. Pat. No. 5,074,319 to White et al.; U.S. Pat. No. 5,099,862 to White et al.; U.S. Pat. No. 5,121,757 to White et al.; U.S. Pat. No. 5,131,415 to Munoz et al.; U.S. Pat. No. 5,230,354 to Smith et al.; U.S. Pat. No. 5,235,992 to Sensabaugh; U.S. Pat. No. 5,243,999 to Smith; U.S. Pat. No. 5,301,694 to Raymond; U.S. Pat. No. 5,318,050 to Gonzalez-Parra et al.; U.S. Pat. No. 5,435,325 to Clapp et al.; and U.S. Pat. No. 5,445,169 to Brinkley et al.; the disclosures of which are incorporated herein by reference in their entireties.

The smoking article further can comprise one or more flavors, medicaments, or other inhalable materials. For example, liquid nicotine can be used. Such further materials can be included in the aerosol precursor or vapor precursor composition. Thus, the aerosol precursor or vapor precursor composition can be described as comprising an inhalable substance that is not necessarily produced as a visible aerosol. Such inhalable substance can include flavors, medicaments, and other materials as discussed herein. Particularly, an inhalable substance delivered using a smoking article according to the present invention can comprise a tobacco component or a tobacco-derived material. For example, the aerosol precursor composition can comprise a slurry or solution with tobacco, a tobacco component, or a tobacco-derived material.

The various components of the aerosol precursor composition (e.g., polyhydric alcohols, flavors, medicaments, etc.) can be provided in one or more reservoirs. As such, defined aliquots of the various components can be separately or simultaneously delivered to the resistive heating element for aerosolization in an air stream to be inhaled by a user. The components of the aerosol precursor composition can be transported to an aerosolization zone so as to be in proximity to a heating element. The proximity preferably is sufficient such that heating of the resistive heating element provides heat to the components sufficient to volatilize and release the components in an inhalable form.

A wide variety of types of flavoring agents, or materials that alter the sensory or organoleptic character or nature of the mainstream aerosol of the smoking article can be employed. Such flavoring agents can be provided from sources other than tobacco, can be natural or artificial in nature, and can be employed as concentrates or flavor packages. Such agents can be supplied directly to the resistive heating element or can be provided on a substrate positioned within the aerosolization zone so as to be stored separate from the further components of the aerosol precursor composition. Exemplary flavoring agents include vanillin, ethyl vanillin, cream, tea, coffee, fruit (e.g., apple, cherry, strawberry, peach and citrus flavors, including lime and lemon), maple, menthol, mint, peppermint, spearmint, wintergreen, nutmeg, clove, lavender, cardamom, ginger, honey, anise, sage, cinnamon, sandalwood, jasmine, cascarilla, cocoa, licorice, and flavorings and flavor packages of the type and character traditionally used for the flavoring of cigarette, cigar, and pipe tobaccos. Syrups, such as high fructose corn syrup, also can be employed. Flavoring agents also can include acidic or basic characteristics (e.g., organic acids, such as levulinic acid, succinic acid, and pyruvic acid). The flavoring agents can be combined with the aerosol-generating material if desired. Exemplary plant-derived compositions that can be used are disclosed in U.S. application Ser. No. 12/971,746 to Dube et al. and U.S. application Ser. No. 13/015,744 to Dube et al., the disclosures of which are incorporated herein by reference in their entireties. The selection of such further components can vary based upon factors such as the sensory characteristics that are desired for the present article, and the present invention is intended to encompass any such further components that can be readily apparent to those skilled in the art of tobacco and tobacco-related or tobacco-derived products. See, Gutcho, Tobacco Flavoring Substances and Methods, Noyes Data Corp. (1972) and Leffingwell et al., Tobacco Flavoring for Smoking Products (1972), the disclosures of which are incorporated herein by reference in their entireties. Any of the materials, such as flavorings, casings, and the like that can be useful in combination with a tobacco material to affect sensory properties thereof, including organoleptic properties, such as already described herein, can be combined with the aerosol precursor composition. Organic acids particularly can be incorporated into the aerosol precursor to affect the flavor, sensation, or organoleptic properties of medicaments, such as nicotine, that can be combined with the aerosol precursor. For example, organic acids, such as levulinic acid, lactic acid, and pyruvic acid, can be included in the aerosol precursor with nicotine in amounts up to being equimolar (based on total organic acid content) with the nicotine. Any combination of organic acids can be used. For example, the aerosol precursor can include about 0.1 to about 0.5 moles of levulinic acid per one mole of nicotine, about 0.1 to about 0.5 moles of pyruvic acid per one mole of nicotine, about 0.1 to about 0.5 moles of lactic acid per one mole of nicotine, or combinations thereof, up to a concentration wherein the total amount of organic acid present is equimolar to the total amount of nicotine present in the aerosol precursor.

The aerosol precursor composition can take on a variety of conformations based upon the various amounts of materials utilized therein. For example, a useful aerosol precursor composition can comprise up to about 98% by weight up to about 95% by weight, or up to about 90% by weight of a polyol. This total amount can be split in any combination between two or more different polyols. For example, one polyol can comprise about 50% to about 90%, about 60% to about 90%, or about 75% to about 90% by weight of the aerosol precursor, and a second polyol can comprise about 2% to about 45%, about 2% to about 25%, or about 2% to about 10% by weight of the aerosol precursor. A useful aerosol precursor also can comprise up to about 25% by weight, about 20% by weight or about 15% by weight water—particularly about 2% to about 25%, about 5% to about 20%, or about 7% to about 15% by weight water. Flavors and the like (which can include medicaments, such as nicotine) can comprise up to about 10%, up to about 8%, or up to about 5% by weight of the aerosol precursor.

As a non-limiting example, an aerosol precursor according to the invention can comprise glycerol, propylene glycol, water, nicotine, and one or more flavors. Specifically, the glycerol can be present in an amount of about 70% to about 90% by weight, about 70% to about 85% by weight, or about 75% to about 85% by weight, the propylene glycol can be present in an amount of about 1% to about 10% by weight, about 1% to about 8% by weight, or about 2% to about 6% by weight, the water can be present in an amount of about 10% to about 20% by weight, about 10% to about 18% by weight, or about 12% to about 16% by weight, the nicotine can be present in an amount of about 0.1% to about 5% by weight, about 0.5% to about 4% by weight, or about 1% to about 3% by weight, and the flavors can be present in an amount of up to about 5% by weight, up to about 3% by weight, or up to about 1% by weight, all amounts being based on the total weight of the aerosol precursor. One specific, non-limiting example of an aerosol precursor comprises about 75% to about 80% by weight glycerol, about 13% to about 15% by weight water, about 4% to about 6% by weight propylene glycol, about 2% to about 3% by weight nicotine, and about 0.1% to about 0.5% by weight flavors. The nicotine, for example, can be a high nicotine content tobacco extract.

The amount of aerosol precursor composition that is used within the smoking article is such that the article exhibits acceptable sensory and organoleptic properties, and desirable performance characteristics. Typically, the amount of aerosol-generating material incorporated into the smoking article is in the range of about 1.5 g or less, about 1 g or less, or about 0.5 g or less. The amount of aerosol precursor composition can be dependent upon factors such as the number of puffs desired per cartridge used with the smoking article. It is desirable for the aerosol-generating composition not to introduce significant degrees of unacceptable off-taste, filmy mouth-feel, or an overall sensory experience that is significantly different from that of a traditional type of cigarette that generates mainstream smoke by burning tobacco cut filler. The selection of the particular aerosol precursor components and reservoir material, the amounts of those components used, and the types of tobacco material used, can be altered in order to control the overall chemical composition of the mainstream aerosol produced by the smoking article.

The amount of aerosol released by the inventive article can vary. Preferably, the article is configured with a sufficient amount of the individual components of the aerosol precursor composition to function at a sufficient temperature for a sufficient time to release a desired content of aerosolized materials over a course of use. The content can be provided in a single inhalation from the article or can be divided so as to be provided through a number of puffs from the article over a relatively short length of time (e.g., less than 30 minutes, less than 20 minutes, less than 15 minutes, less than 10 minutes, or less than 5 minutes). For example, the article can provide nicotine in an amount of about 0.01 mg to about 0.5 mg, about 0.05 mg to about 0.3 mg, or about 0.1 mg to about 0.2 mg per puff on the article. In other embodiments, a desired amount can be characterized in relation to the content of wet total particulate matter delivered based on puff duration and volume. For example, the article can deliver at least 0.1 mg of wet total particulate matter on each puff, for a defined number of puffs (as otherwise described herein), when smoked under standard FTC smoking conditions of 2 second, 35 ml puffs. Such testing can be carried out using any standard smoking machine. In other embodiments, the content of wet total particulate matter (WTPM) delivered under the same conditions on each puff (of approximately 2 seconds in duration) can be at least 1.5 mg, at least 1.7 mg, at least 2.0 mg, at least 2.5 mg, at least 3.0 mg, about 1.0 mg to about 5.0 mg, about 1.5 mg to about 4.0 mg, about 2.0 mg to about 4.0 mg, or about 2.0 mg to about 3.0 mg. Such values can relate to the content of aerosol precursor composition that is delivered alone or in combination with any further inhalable substances that are being delivered by the article. For purposes of calculations, an average puff time of about 2 seconds can deliver a puff volume of about 5 ml to about 100 ml, about 15 ml to about 70 ml, about 20 ml to about 60 ml, or about 25 ml to about 50 ml. Such total puff volume can provide, in certain embodiments, the WTPM content previously described. Thus, WTPM as delivered can be characterized in relation to the total puff volume—e.g., about 1 mg to about 4 mg WTPM in a total puff volume of about 25 ml to about 75 ml. Such characterization is inclusive of all puff volume values and WTPM values otherwise described herein. A smoking article according to the invention can be configured to provide any number of puffs calculable by the total amount of components of the aerosol precursor composition to be delivered (or the total WTPM to be delivered) divided by the amount to be delivered per puff. The one or more reservoirs can be loaded with the appropriate amount of the components of the aerosol precursor composition to achieve the desired number of puffs and/or the desired total amount of material to be delivered.

In further embodiments, heating can be characterized in relation to the amount of aerosol to be generated. Specifically, the article can be configured to provide an amount of heat necessary to generate a defined volume of aerosol (e.g., about 5 ml to about 100 ml, or any other volume deemed useful in a smoking article, such as otherwise described herein). In certain embodiments, the amount of heat generated can be measured in relation to a two second puff providing about 35 ml of aerosol at a heater temperature of about 290° C. In some embodiments, the article preferably can provide about 1 to about 50 Joules of heat per second (J/s), about 2 J/s to about 40 J/s, about 3 J/s to about 35 J/s, or about 5 J/s to about 30 J/s.

The resistive heating element preferably is in electrical connection with the power source of the smoking article such that electrical energy can be provided to the resistive heating element to produce heat and subsequently aerosolize the aerosol precursor composition and any other inhalable substance provided by the smoking article. Such electrical connection can be permanent (e.g., hard wired) or can be removable (e.g., wherein the resistive heating element is provided in a cartridge that can be attached to and detached from a control body that includes the power source).

Although a variety of materials for use in a smoking article according to the present invention have been described above—such as heaters, batteries, capacitors, switching components, aerosol precursors, and the like, the invention should not be construed as being limited to only the exemplified embodiments. Rather, one of skill in the art can recognize based on the present disclosure similar components in the field that can be interchanged with any specific component of the present invention. For example, U.S. Pat. No. 5,261,424 to Sprinkel, Jr. discloses piezoelectric sensors that can be associated with the mouth-end of a device to detect user lip activity associated with taking a draw and then trigger heating; U.S. Pat. No. 5,372,148 to McCafferty et al. discloses a puff sensor for controlling energy flow into a heating load array in response to pressure drop through a mouthpiece; U.S. Pat. No. 5,967,148 to Harris et al. discloses receptacles in a smoking device that include an identifier that detects a non-uniformity in infrared transmissivity of an inserted component and a controller that executes a detection routine as the component is inserted into the receptacle; U.S. Pat. No. 6,040,560 to Fleischhauer et al. describes a defined executable power cycle with multiple differential phases; U.S. Pat. No. 5,934,289 to Watkins et al. discloses photonic-optronic components; U.S. Pat. No. 5,954,979 to Counts et al. discloses means for altering draw resistance through a smoking device; U.S. Pat. No. 6,803,545 to Blake et al. discloses specific battery configurations for use in smoking devices; U.S. Pat. No. 7,293,565 to Griffen et al. discloses various charging systems for use with smoking devices; US 2009/0320863 by Fernando et al. discloses computer interfacing means for smoking devices to facilitate charging and allow computer control of the device; US 2010/0163063 by Fernando et al. discloses identification systems for smoking devices; and WO 2010/003480 by Flick discloses a fluid flow sensing system indicative of a puff in an aerosol generating system; all of the foregoing disclosures being incorporated herein by reference in their entireties. Further examples of components related to electronic aerosol delivery articles and disclosing materials or components that can be used in the present article include U.S. Pat. No. 4,735,217 to Gerth et al.; U.S. Pat. No. 5,249,586 to Morgan et al.; U.S. Pat. No. 5,666,977 to Higgins et al.; U.S. Pat. No. 6,053,176 to Adams et al.; U.S. Pat. No. 6,164,287 to White; U.S. Pat. No. 6,196,218 to Voges; U.S. Pat. No. 6,810,883 to Felter et al.; U.S. Pat. No. 6,854,461 to Nichols; U.S. Pat. No. 7,832,410 to Hon; U.S. Pat. No. 7,513,253 to Kobayashi; U.S. Pat. No. 7,896,006 to Hamano; U.S. Pat. No. 6,772,756 to Shayan; US Pat. Pub. Nos. 2009/0095311, 2006/0196518, 2009/0126745, and 2009/0188490 to Hon; US Pat. Pub. No. 2009/0272379 to Thorens et al.; US Pat. Pub. Nos. 2009/0260641 and 2009/0260642 to Monsees et al.; US Pat. Pub. Nos. 2008/0149118 and 2010/0024834 to Oglesby et al.; US Pat. Pub. No. 2010/0307518 to Wang; and WO 2010/091593 to Hon. A variety of the materials disclosed by the foregoing documents can be incorporated into the present devices in various embodiments, and all of the foregoing disclosures are incorporated herein by reference in their entireties.

Although an article according to the invention can take on a variety of embodiments, as discussed in detail below, the use of the article by a consumer will be similar in scope. In particular, the article can be provided as a single unit or as a plurality of components that are combined by the consumer for use and then are dismantled by the consumer thereafter. Generally, a smoking article according to the invention can comprise a first unit that is engageable and disengeagable with a second unit, the first unit comprising the resistive heating element, and the second unit comprising the electrical power source. In some embodiments, the second unit further can comprise one or more control components that actuate or regulate current flow from the electrical power source. The first unit can comprise a distal end that engages the second unit and an opposing, proximate end that includes a mouthpiece (or simply the mouthend) with an opening at a proximate end thereof. The first unit can comprise an air flow path opening into the mouthpiece of the first unit, and the air flow path can provide for passage of aerosol formed from the resistive heating element into the mouthpiece. In preferred embodiments, the first unit can be disposable. Likewise, the second unit can be reusable.

More specifically, a smoking article according to the invention can have a reusable control body that is substantially cylindrical in shape having a connecting end and an opposing, closed end. The closed end of the control housing can include one or more indicators of active use of the article. The article further can comprise a cartridge with a connecting end that engages the connecting end of the control body and with an opposing, mouthend. To use the article, the consumer can connect a connecting end of the cartridge to the connecting end of the control body or otherwise combine the cartridge with the control body so that the article is operable as discussed herein. In some embodiments, the connecting ends of the control body and the cartridge can be threaded for a screw-type engagement. In other embodiments, the connecting ends can have a press-fit engagement.

During use, the consumer initiates heating of the resistive heating element, the heat produced by the resistive heating element aerosolizes the components of the aerosol precursor composition. Such heating releases at least a portion of the aerosol precursor composition in the form of an aerosol and such aerosol is provided within a space inside the cartridge (e.g., an aerosolization zone) that is in fluid communication with the mouthend of the cartridge. When the consumer inhales on the mouth end of the cartridge, air is drawn through the cartridge, and the combination of the drawn air and the aerosol is inhaled by the consumer as the drawn materials exit the mouth end of the cartridge (and any optional mouthpiece present) into the mouth of the consumer. To initiate heating, the consumer can actuate a pushbutton, capacitive sensor, or similar component that causes the resistive heating element to receive electrical energy from the battery or other energy source (such as a capacitor). The electrical energy can be supplied for a pre-determined length of time or can be manually controlled. Preferably, flow of electrical energy does not substantially proceed in between puffs on the article (although energy flow can proceed to maintain a baseline temperature greater than ambient temperature—e.g., a temperature that facilitates rapid heating to the active heating temperature). In further embodiments, heating can be initiated by the puffing action of the consumer through use of various sensors, as otherwise described herein. Once the puff is discontinued, heating will stop or be reduced. When the consumer has taken a sufficient number of puffs so as to have released a sufficient amount of the inhalable substance (e.g., an amount sufficient to equate to a typical smoking experience), the cartridge can be removed from the control housing and discarded.

Indication that the cartridge is spent (i.e., the aerosol precursor composition has been substantially removed by the consumer) can be provided. In some embodiments, a single cartridge can provide more than a single smoking experience and thus can provide a sufficient content of aerosol precursor composition to simulate as much as full pack of conventional cigarettes or even more.

The foregoing description of use of the article can be applied to the various embodiments described through minor modifications, which can be apparent to the person of skill in the art in light of the further disclosure provided herein. The above description of use, however, is not intended to limit the use of the inventive article but is provided to comply with all necessary requirements of disclosure of the present invention.

Referring now to FIG. 1, a smoking article 10 according to the invention generally can comprise a shell 15 and a plurality of components provided within the shell. The article can be characterized as having a mouthend 11 (i.e., the end upon which a consumer can draw to inhale aerosol from the article), and a distal end 12. The illustrated article is provided as a single unitary device (however, line A indicates an optional demarcation whereby the device can be two separate components that are joined together, either removably or permanently, such as by gluing). As will be evident from the further disclosure herein, it can be preferable for further embodiments of the article to be formed of two or more detachable units, each housing separate components of the article. The various components shown in the embodiment of FIG. 1 can be present in other embodiments, including embodiments formed of multiple units.

The article 10 according to the invention can have an overall shape that can be defined as being substantially rod-like or substantially tubular shaped or substantially cylindrically shaped. As illustrated in FIG. 1, the article has a substantially round cross-section; however, other cross-sectional shapes (e.g., oval, square, triangle, etc.) also are encompassed by the present disclosure. Such language that is descriptive of the physical shape of the article can also be applied to the individual units of the article in embodiments comprising multiple units, such as a control body and a cartridge.

The shell 15 of the smoking article 10 can be formed of any material suitable for forming and maintaining an appropriate conformation, such as a tubular shape, and for retaining therein the suitable components of the article. The shell can be formed of a single wall, as shown in FIG. 1. In some embodiments, the shell can be formed of a material (natural or synthetic) that is heat resistant so as to retain its structural integrity—e.g., does not degrade—at least at a temperature that is the heating temperature provided by the resistive heating element, as further discussed herein. In some embodiments, a heat resistant polymer can be used. In other embodiments, the shell can be formed from paper, such as a paper that is substantially straw-shaped. As further discussed herein, the shell, such as a paper tube, can have one or more layers associated therewith that function to substantially prevent movement of vapor therethrough. In one example, an aluminum foil layer can be laminated to one surface of the shell. Ceramic materials also can be used.

In further embodiments, a smoking article 10 according to the invention can include a variety of materials that can provide specific functionalities. For example, FIG. 2 shows a cross-section of a smoking article 10 near the mouthend 11 of the article. In this embodiment, an insulator layer 70 can be included, specifically in the area of the shell 15 where the resistive heating element 50 is present, so as not to unnecessarily move heat away from the resistive heating element. The insulator layer, however, can be present in other areas of the article (including substantially the entire length of the article). For example, in embodiments wherein the article comprises a control body and a separate cartridge, the control body can include an insulator layer, if desired. The insulator layer 70 can be formed of a paper or other fibrous material, such as a cellulose. In such embodiments, so as to prevent movement of the aerosol precursor composition outward toward the surface of the article, it can be useful to include a barrier layer 75, which can comprise any material that is impervious to the particular components of the aerosol precursor composition, such as a metal foil, waxed paper, or the like. Further, the shell 15 can include an overwrap 115 on at least a portion thereof, such as at the mouthend 11 of the article, and such overwrap also can be formed of multiple layers. The overwrap can be, for example, a typical wrapping paper in a cigarette. The overwrap particularly can comprise a material typically used in a filter element of a conventional cigarette, such as cellulose acetate and thus can function to provide the sensation of a conventional cigarette in the mouth of a consumer. Exemplary types of wrapping materials, wrapping material components, and treated wrapping materials that can be used in an overwrap in the present invention are described in U.S. Pat. No. 5,105,838 to White et al.; U.S. Pat. No. 5,271,419 to Arzonico et al.; U.S. Pat. No. 5,220,930 to Gentry; U.S. Pat. No. 6,908,874 to Woodhead et al.; U.S. Pat. No. 6,929,013 to Ashcraft et al.; U.S. Pat. No. 7,195,019 to Hancock et al.; U.S. Pat. No. 7,276,120 to Holmes; U.S. Pat. No. 7,275,548 to Hancock et al.; PCT WO 01/08514 to Fournier et al.; and PCT WO 03/043450 to Hajaligol et al., the disclosures of which are incorporated herein by reference in their entireties. Representative wrapping materials are commercially available as R. J. Reynolds Tobacco Company Grades 119, 170, 419, 453, 454, 456, 465, 466, 490, 525, 535, 557, 652, 664, 672, 676 and 680 from Schweitzer-Mauduit International.

To maximize aerosol and flavor delivery which otherwise can be diluted by radial (i.e., outside) air infiltration through the shell 15, one or more layers of non-porous cigarette paper can be used to envelop the article (with or without the overwrap present). Examples of suitable non-porous cigarette papers are commercially available from Kimberly-Clark Corp. as KC-63-5, P878-5, P878-16-2 and 780-63-5. Preferably, the overwrap is a material that is substantially impermeable to the vapor formed during use of the inventive article. If desired, the overwrap (or the shell if the overwrap is absent) can comprise a resilient paperboard material, foil-lined paperboard, metal, polymeric materials, foams, nanofiber webs, or the like, and this material can be circumscribed by a cigarette paper wrap. Moreover, the article 10 can include a tipping paper that circumscribes the article and optionally can be used to attach a filter material to the article.

The shell 15, when formed of a single layer, can have a thickness of about 0.2 mm to about 3.0 mm, about 0.3 mm to about 2.0 mm, about 0.4 mm to about 1.5 mm, or about 0.5 mm to about 1.25 mm. The addition of further layers, as discussed above, can add to the thickness of the shell. Further exemplary types of components and materials that can be used to provide the functions described above or be used as alternatives to the materials and components noted above can be those of the types set forth in US Pub. No. 2010/00186757 to Crooks et al. and US Pub. No. 2011/0041861 to Sebastian et al., the disclosures of which are incorporated herein by reference in their entireties.

As seen in the embodiment of FIG. 1, the smoking article 10 includes an electronic control component 20, a flow sensor 30, and a battery 40, and these components can be placed in a variety of orders within the article. Although not expressly shown, it is understood that the article 10 can include wiring as necessary to provide power from the battery 40 to the further components and to interconnect the components for appropriate operation of the necessary functions provided by the article. The article 10 further includes a resistive heating element 50 as described herein. In the illustrated embodiment, the resistive heating element 50 is a metal coil that can be electrically connected to the battery 40 through appropriate wiring of the terminals 51 to facilitate formation of a closed electrical circuit with current flowing through the heating element. Further wiring (not illustrated) can be included to provide the necessary electrical connections within the article. In specific embodiments, the article 10 can be wired with an electrical circuit such that the control component 20 delivers, controls, or otherwise modulates power from the battery 40 for energizing the resistive heating element 50 according to one or more defined algorithms, including pulse width modulation, such as already described above. Such electrical circuit can specifically incorporate the flow sensor 30 such that the article 10 is only active at times of use by the consumer. For example, when a consumer puffs on the article 10, the flow sensor detects the puff, and the control component 20 is then activated to direct power through the article such that the resistive heating element 50 produces heat and thus provides aerosol for inhalation by the consumer. The control algorithm can call for power to the resistive heating element 50 to cycle and thus maintain a defined temperature. The control algorithm therefore can be programmed to automatically deactivate the article 10 and discontinue power flow through the article after a defined time lapse without a puff by a consumer. Moreover, the article can include a temperature sensor to provide feedback to the control component. Such sensor can be, for example, in direct contact with the resistive heating element 50. Alternative temperature sensing means likewise can be used, such as relying upon logic control components to evaluate resistance through the resistive heating element and correlate such resistance to the temperature of the element. In other embodiments, the flow sensor 30 can be replaced by appropriate components to provide alternative sensing means, such as capacitive sensing, as otherwise described herein. Any variety of sensors and combinations thereof can be incorporated, as already described herein. Still further, one or more control buttons 16 can be included to allow for manual actuation by a consumer to elicit a variety of functions, such as powering the article 10 on and off, turning on the heating element 50 to generate a vapor or aerosol for inhalation, or the like.

Additionally, the article can include one or more status indicators 19 positioned on the shell 15. Such indicators, as discussed above, can show the number of puffs taken or remaining from the article, can be indicative of an active or inactive status, can light up in response to a puff, or the like. Although six indicators are illustrated, more or fewer indicators can be present, and the indicators can take on different shapes and orientations and can even be simply an opening in the shell (such as for release of sound when such indicators are present).

As illustrated in the embodiment of FIG. 1, a reservoir bottle 205 is shown in proximity to the heating element 50, and a transport element 300 (a wick in this embodiment) extends from the reservoir bottle 205 and into the coil of the resistive heating element 50. The reservoir bottle is one embodiment illustrating means of storing an aerosol precursor composition. The wick utilizes capillary action to draw the aerosol precursor composition from the reservoir bottle and into an aerosolization zone 400 defined by the area in and around the resistive heating element 50 in the form of a metal wire coil. As such, heat produced by the resistive heating element causes the aerosol precursor composition to aerosolize in the space around the resistive heating element (i.e., the aerosolization zone). The formed aerosol is then drawn by a user through the mouthend 11 of the smoking article 10. As the aerosol precursor composition in the aerosolization zone is aerosolized by the heating of the resistive heating element, further aerosol precursor composition is wicked out of the reservoir bottle 205 to the aerosolization zone for aerosolization. The cycle continues until substantially all of the aerosol precursor composition has been aerosolized.

As seen in the embodiment of FIG. 1, the mouthend 11 of the article 10 is substantially an open cavity with the resistive heating element 50 and the reservoir bottle 205 disposed therein. Such open cavity provides a volume for release of the aerosol from the transport element 300 as it is withdrawn from the reservoir and heated by the resistive heating element. The article also includes a mouth opening 18 in the mouthend 11 to allow for withdrawal of the aerosol from the cavity around the resistive heating element 50. Although not expressly shown in the illustration of FIG. 1, the article can include a filter material (such as cellulose acetate or polypropylene) in the mouthend thereof to increase the structural integrity thereof and/or to provide filtering capacity, if desired, and/or to provide resistance to draw. For example, an article according to the invention can exhibit a pressure drop of about 50 to about 250 mm water pressure drop at 17.5 cc/second air flow. In further embodiments, pressure drop can be about 60 mm to about 180 mm or about 70 mm to about 150 mm. Pressure drop value can be measured using a Filtrona Filter Test Station (CTS Series) available from Filtrona Instruments and Automation Ltd or a Quality Test Module (QTM) available from the Cerulean Division of Molins, PLC. To facilitate air flow through the article, an air intake 17 can be provided and can substantially comprise an aperture in the shell 15 that allows for air flow into the interior of the article. A plurality of air intakes can be provided, and the air intakes can be positioned at any location upstream from the mouthend of the article such that air from the air intake can mingle with and facilitate removal of the formed aerosol from the cavity around the resistive heating element and through the opening in the mouthend of the article. Although not illustrated, if desired, structural elements can be provided within the article so as to effectively isolate one or more components within the article from the air flowing from the air intake to the opening in the mouthend. In other words, a defined air flow path can be provided, and such defined air flow path can substantially avoid air flowing through the air flow path from coming into physical contact with one or both of the battery 40 and the control component 20. As illustrated in FIG. 1, air taken in through the air intake 17 passes the flow sensor 30 before entering the cavity surrounding the heating element such that activation of the flow sensor will facilitate heating of the heating element, as otherwise described herein.

In the embodiment shown in FIG. 2, the aerosol precursor composition is stored in a reservoir layer 200, which can be a layer of porous material that is at least partially saturated with the aerosol precursor composition. In such embodiments, the cavity in the mouthend 11 of the article 10 can be significantly reduced. As seen in FIG. 2, an aerosol passage tube 250 is positioned downstream from the resistive heating element 50 coiled around the transport element 300. Aerosol formed by heating of the aerosol precursor composition in the transport element by the resistive heating element can be drawn by a user through an aerosol passage 260 defined by the aerosol passage tube.

In preferred embodiments, the article 10 can take on a size that is comparative to a cigarette or cigar shape. Thus, the article can have a diameter of about 5 mm to about 25 mm, about 5 mm to about 20 mm, about 6 mm to about 15 mm, or about 6 mm to about 10 mm. Such dimension can particularly correspond to the outer diameter of the shell 15.

The smoking article 10 in the embodiment illustrated in FIG. 1 can be characterized as a disposable article. Accordingly, it can be desirable for the reservoir containing the aerosol precursor composition in such embodiments to include a sufficient amount of aerosol precursor composition so that a consumer can obtain more than a single use of the article. For example, the article can include sufficient aerosolizable and/or inhalable materials such that the article can provide a number of puffs substantially equivalent to the number of puffs (each of about two to four seconds duration) available from a plurality of conventional cigarettes—e.g., 2 or more, 5 or more, 10 or more, or 20 or more conventional cigarettes. More particularly, a disposable, single unit article according to the embodiment of FIG. 1 can provide about 20 or more, about 50 or more, or about 100 or more puffs, a single puff being measured as already described herein.

In particularly preferred embodiments an article according to the invention can comprise two units that are attachable and detachable from each other. For example, FIG. 3 shows a smoking article 10 according to one embodiment that is formed of a control body 80 and a cartridge 90. In specific embodiments, the control body can be referred to as being reusable, and the cartridge can be referred to as being disposable. In some embodiments, the entire article can be characterized as being disposable in that the control body can be configured for only a limited number of uses (e.g., until a battery power component no longer provides sufficient power to the article) with a limited number of cartridges and, thereafter, the entire article 10, including the control body, can be discarded. In other embodiments, the control body can have a replaceable battery such that the control body can be reused through a number of battery exchanges and with many cartridges. Similarly, the article 10 can be rechargeable and thus can be combined with any type of recharging technology, including connection to a typical electrical outlet, connection to a car charger (i.e., cigarette lighter receptacle), and connection to a computer, such as through a USB cable.

The control body 80 and the cartridge 90 are specifically configured so as to engage one another and form an interconnected, functioning device. As illustrated in FIG. 3, the control body 80 includes a proximal attachment end 13 that includes a projection 82 having a reduced diameter in relation to the control body. The cartridge includes a distal attachment end 14 that engages the proximal engagement end of the control body 80 to provide the smoking article 10 in a functioning, usable form. In FIG. 3, the control body projection 82 includes threads that allow the cartridge 90 to screw onto the control body 80 via corresponding threads (not visible in FIG. 3) in the distal attachment end of the cartridge. Thus, the distal attachment end of the cartridge 90 can include an open cavity for receiving the control body projection 82. Although a threaded engagement is illustrated in FIG. 3, it is understood that further means of engagement are encompassed, such as a press-fit engagement, a magnetic engagement, or the like.

The functioning relationship between the control body 80 and the cartridge 90 is further seen in FIG. 4, which shows the two detached units in cross section. The control body 80 includes the control component 20, flow sensor 30, and battery 40. Although these components are illustrated in a specific alignment, it is understood that various alignments of the components are encompassed by the invention. The control body 80 further includes a plurality of indicators 19 and an air intake 17 in the control body shell 81. Various positions for one or more air intakes are encompassed by the invention. As shown, the air intake 17 is positioned such that air drawn through the intake sufficiently contacts the flow sensor 30 to activate the sensor (although other positions are encompassed, particularly if different sensing means are provided or if manual actuation, such as with a push button, is provided). The shell 81 can be formed of materials already described herein in relation to the embodiment of FIG. 1. A receptacle 60 also is included at the proximal attachment end 13 of the control body 80 and extends into the control body projection 82 to allow for ease of electrical connection with the resistive heating element 50 when the cartridge 90 is attached to the control body. In the illustrated embodiment, the receptacle 60 includes a central open passage to facilitate air flow from the air intake in the control body into the cartridge during use of the article 10.

The cartridge 90 includes a cartridge shell 91 with a mouth opening 18 at the mouthend 11 thereof to allow passage of air and entrained vapor (i.e., the components of the aerosol precursor composition in an inhalable form) from the cartridge to a consumer during draw on the article 10. The cartridge shell 91 (and an optional insulator layer and/or filter) can be formed of materials as already described herein as being useful for such purpose. The cartridge 90 further includes a resistive heating element 50 in the form of a metal wire coil. The resistive heating element includes terminals 51 (e.g., positive and negative terminals) at the opposing ends thereof for facilitating current flow through the resistive heating element and for attachment of the appropriate wiring (not illustrated) to form an electrical connection of the resistive heating element with the battery 40 when the cartridge 90 is connected to the control body 80. Specifically, a plug 65 is positioned at the distal attachment end 14 of the cartridge. When the cartridge 90 is connected to the control body 80, the plug 65 engages the receptacle 60 to form an electrical connection such that current controllably flows from the battery 40, through the receptacle and plug, and to the resistive heating element 50. The cartridge shell 91 can continue across the distal attachment end such that this end of the cartridge is substantially closed with the plug protruding therefrom. As illustrated in FIG. 4, the plug 65 includes an open central passage that aligns with the open central passage in the receptacle 60 to allow air to flow from the control body 80 and into the cartridge 90.

Generally, in use, when a consumer draws on the mouthend 11 of the cartridge, the flow sensor 30 detects the change in flow and activates the control component 20 to facilitate current flow through the resistive heating element 50. Thus, it is useful for air flow to travel through the control body 80 in a manner that flow sensor 30 detects air flow almost instantaneously. When the flow sensor 30 is positioned within the control body 80, it can be useful to have an air intake 17 on the control body. If desired, a sealed flow path can be provided such that the flow sensor 30 within the control body 80 is in fluid connection with the cartridge interior after the cartridge and the control body are engaged, such fluid connection being sealed with respect to the remainder of the components within the control body but opening into the cartridge 90 when attached to the control body. Further, in other embodiments, the flow sensor 30 can be located within the cartridge 90 instead of the control body 80.

In the embodiment illustrated in FIG. 4, two separate reservoirs and two separate transport elements are shown. A reservoir for use according to the present invention can be any component that functions to store and release one or more components of the aerosol precursor composition. In some embodiments, such as illustrated in FIG. 1, the reservoir can be a container, such as a bottle, in which the aerosol precursor composition is stored. The container can be substantially impermeable in relation to the aerosol precursor such that the material cannot escape through the walls of the container. In such embodiments, an opening can be provided for passage of the aerosol precursor composition therefrom. For example, in FIG. 1, a transport element 300 (e.g., a wick) is shown filling an opening in the reservoir bottle 205. The term "bottle" is meant to generally encompass any container having walls and at least one opening. The aerosol precursor composition in the reservoir bottle thus moves out of the bottle by capillary action via the wick. Other systems for passage of the aerosol precursor composition from a reservoir bottle are also encompassed by the invention. For example, a tube or other conduit can be used for passage of the aerosol precursor composition out of the bottle and through the tube or other conduit. Alternately, passive or active flow of the liquid from the bottle can be controlled with an appropriate valve mechanism that can be opened to allow flow of the aerosol precursor composition when the smoking article is in use and to prevent flow of the aerosol precursor composition when the smoking article is not in use. Active flow mechanisms incorporating micro-pump devices are envisioned for use according to the present invention. Such container can be formed of any suitable material that is not substantially reactive with any components of the aerosol precursor composition, such as glass, metal, low- or no-porosity ceramics, plastics, and the like.

In some embodiments, a reservoir can be a container that is provided without an opening, but a portion or all of the walls of the container can be porous and thus allow permeation of the aerosol precursor composition out of the container through the walls thereof. For example, porous ceramics can be useful in such regard. Any other material of suitable porosity likewise could be used. In such embodiments, at least a portion of the porous container can be in contact with the resistive heating element such that aerosol precursor composition exiting the bottle can be vaporized by the heater. Alternately, a further transport element can be in contact with the porous bottle to transport the aerosol precursor composition from the container and to the heater.

In particular embodiments, a reservoir can be a woven or non-woven fabric or another mass of fibers suitable for retaining the aerosol precursor composition (e.g., through absorption, adsorption, or the like) and allowing wicking away of the precursor composition for transport to the aerosolization zone. For example, FIG. 4 illustrates a first reservoir layer 201 and a second reservoir layer 202, each retaining one or more components of the aerosol precursor composition. In each case, the reservoir layer is essentially a non-woven layer of fibers rolled into the form of a tube that lines a portion of the inner surface of the cartridge shell 91. Such reservoir layers can be formed of natural fibers, synthetic fibers, or combinations thereof. Non-limiting examples of useful materials include cotton, cellulose, polyesters, polyamides, polylactic acids, combinations thereof, and the like. Similarly, reservoir layers can be formed of ceramics or other porous material that retains (i.e., can be at least partially saturated with) a liquid composition combined therewith. A smoking article according to the present invention can include one reservoir or a plurality of reservoirs (e.g., two reservoirs, three reservoirs, four reservoirs, or even more).

A transport element for use according to the present invention can be any component that functions to transport one or more components of an aerosol precursor composition from a reservoir to an aerosolization zone in the smoking article where a resistive heating element aerosolizes the aerosol precursor composition and thus form an aerosol. A transport element particularly can be a wick that utilizes capillary action in the transport of liquids. A wick for use according to the invention thus can be any material that provides sufficient wicking action to transport one or more components of the aerosol precursor composition to the aerosolization zone. Non-limiting examples include natural and synthetic fibers, such as cotton, cellulose, polyesters, polyamides, polylactic acids, glass fibers, combinations thereof, and the like. Other exemplary materials that can be used in wicks include metals, ceramics, and carbonized materials (e.g., a foam or monolith formed of a carbonaceous material that has undergone calcining to drive off non-carbon components of the material). Wicks further can be coated with materials that alter the capillary action of the fibers, and the fibers used in forming wicks can have specific cross-sectional shape and can be grooved so as to alter the capillary action of the fibers. For example, temperature adaptive polymers can be used. Such adaptive polymers can be coated on fibers or used in other manners, and these polymers are effective for providing altered liquid transport characteristics based on the surrounding conditions. Temperature adaptive polymers particularly can exhibit low transport at reduced temperatures and can exhibit increased transport at increased temperatures. One example is a material known as Adaptive by HeiQ®. Fibers used in forming wicks can be provided singly, bundled, as a woven fabric (including meshes and braids), or as a non-woven fabric. Porosity of the wick material also can be controlled to alter the capillary action of the wick, including controlling average pore size and total porosity. Separate wicks also can have different lengths. The term "wick" is also intended to encompass capillary tubes, and any combination of elements providing the desired capillary action can be used.

While the use of wicks is known, the art has not heretofore recognized the drawbacks that can impede the quality of an aerosol that is generated when an aerosol precursor composition is wicked to a heater for aerosolization. For example, the separate components of an aerosol precursor composition can each transport at different rates along a single wick formed of a specific material. Thus, the ratio of the components at the heater can be different than the ratio of the components in the original aerosol precursor composition since one component can wick to the heater faster or slower than the other components of the aerosol precursor composition. Likewise, separate components of the aerosol precursor composition can exhibit different aerosolization characteristics (e.g., rate of aerosolization or temperature at which aerosolization takes place). When the aerosol precursor composition is exposed to a substantially uniform temperature (or thermal energy input) at the resistive heater element, the separate components of the aerosol precursor composition can aerosolize differently such that a uniform aerosol composition is not achieved in each puff on the article. For example, early puffs on the article can be unintentionally enriched in the components of the aerosol precursor composition that have the lowest temperature of vaporization. It is therefore desirable, such as provided according to the present disclosure, to have a transporting/heating system that can transport and heat the various chemical components of the aerosol precursor composition at a controlled rate so as to achieve a uniform puff chemistry.

The smoking articles described herein provide for generation of aerosols of desired composition by controlling the rate of transport and heating of the components of an aerosol precursor composition. Such smoking articles generally can comprise an aerosolization zone that includes at least one resistive heating element. The aerosolization zone can be defined as an area wherein the aerosol precursor composition is in contact with the resistive heating element or is sufficiently in proximity to the resistive heating element such that heat generated by the resistive heating element causes the aerosol precursor composition to vaporize for aerosol formation. An aerosolization zone can be an area where one or more transport elements are spatially aligned with one or more resistive heating elements such that liquid components transported by the one or more transport elements are heated by the one or more resistive heating elements so as to vaporize and form an aerosol.

A smoking article according to the present invention also generally comprises an electrical power source that is in electrical connection with at least one resistive heating element. Various control elements also can be included, as already discussed above.

Still further, the smoking article includes an aerosol precursor composition, which can comprise a variety of components, as discussed above. Typically, the aerosol precursor composition will be formed of a first component and at least a second component. Thus, the aerosol precursor composition can be formed of a plurality of components. The aerosol precursor composition is provided in the smoking article so as to be in fluid communication with the aerosolization zone such that the aerosol precursor composition is transported from a storage component—i.e., one or more reservoirs—to the aerosolization zone. Such transport can particularly be via capillary action, more particularly along a wick or similar component. At least two separate components of the aerosol precursor composition preferably are separately transported to the aerosolization zone. Such separate transport can mean that the entire content of at least one component of the aerosol precursor composition is transported via means (e.g., a wick) by which at least one other component of the aerosol precursor composition is not transported. Separate transport can apply in this regard to each individual component of the aerosol precursor composition or any combination of the individual components. For example, in a four component aerosol precursor composition, component 1 can be transported by a first transport element and components 2, 3, and 4 can be transported by a second transport element. Alternately, components 1 and 2 can be transported by a first transport element and components 3 and 4 can be transported by a second transport element. Likewise, component 1 can be transported by a first transport element, component 2 can be transported by a second transport element, and components 3 and 4 can be transported by a third transport element. Still further, component 1 can be transported by a first transport element, component 2 can be transported by a second transport element, component 3 can be transported by a third transport element, and component 4 can be transported by a fourth transport element. Separate transport, in other embodiments, can mean that a majority of at least one compound use in the aerosol precursor composition is transported via means through which a majority of at least one different compound in the aerosol precursor is not transported. In such embodiments, separate transport can be defined in that greater than 50%, greater than 60%, greater than 70%, greater than 80%, greater than 90%, or greater than 95% by weight of the individual compound in the aerosol precursor composition is transported by the individual transport element. In specific embodiments, separate transport can mean that 100% by weight of the individual compound in the aerosol precursor composition is transported by the individual transport element. Similarly, separate transport can encompass transport of the same compound in two or more different transport elements so long as each different transport element transports different ratios of the compounds. Moreover, in some embodiments, each separate component forming the aerosol precursor composition can be formed of only a single compound. Likewise, the separate components can be expressly different in that there is no overlap of compounds between the separate components.

In addition to the foregoing, separate transport does not necessitate separate transport along the entire route. For example, component 1 of an aerosol precursor composition can be stored in reservoir 1 and transported by transport element 1, and component 2 of the aerosol precursor composition can be stored in reservoir 2 and transported by transport element 2. At some point prior to entering the aerosolization zone (or more particularly, prior to contacting the resistive heating element), the two separate transport element can be combined or merge into a single transport element to simplify heating. Since the separate components were transported at least partially from the reservoir to the aerosolization zone via separate transport elements, the transport of the components can be considered to be separate. For example, when wicks are used, the separate wicks can be bundled in the aerosolization zone.

Various combinations of one or more reservoirs, one or more transport elements, and one or more heaters, all having various designs and formed of various materials, can be used to achieve controlled rate of transport and heating of the aerosol precursor composition components as discussed herein. In one embodiment, a single reservoir can be used for storage of the aerosol precursor composition, and a plurality of transport elements can be used for transport of the components of the aerosol precursor composition to the aerosolization zone. For example, the multiple separate components of the aerosol precursor composition can be physically separated in the reservoir (e.g., a reservoir bottle with multiple compartments) so as to be in two or more separate compartments, and two or more transport elements (e.g., a separate transport element for each compartment) can be used to transport the respective components from the compartments to the aerosolization zone.

The transport element used to transport a component (or a group of two or more components) of the aerosol precursor composition can be designed to accommodate particular characteristics of the component to be transported. For example, in relation to wicks, for a component that can wick at a slower rate than other components of the aerosol precursor composition, the wick for the slower wicking component can be designed to elicit increased wicking rate. The present invention encompasses a variety of wick designs (or combinations of different types of transport elements) that can be useful to provide customizable transport characteristics that can be applied for use with specific components of an aerosol precursor composition to achieve a consistent and reproducible aerosol.

In some embodiments where wicking is used, the wick cross-section can be designed to achieve the desired result. Typical fibers have a substantially round cross-section, and altering fiber cross-section shape can increase the surface area per denier of the fiber and thus improving wicking along the fiber. For example, a fiber can be formed with longitudinal grooves that are intended to facilitate wicking, such as a 4DG fiber (available from Fiber Innovation Technology) and winged (available from Alasso Industries).

Fibers formed with an "X" or "Y" shaped cross-section also can provide for controlled wicking.

Wicking properties of fibers also can be altered via physical modification of a formed fiber. For example, fibers can be scored or partially cut along the length thereof so as to increase the overall exposed surface area of the fiber. Such scores or cuts can be made at any angle greater than 0° and less than 180° relative to the axis of the fiber.

In other embodiments, at least a portion of a fiber utilized in a wick can be designed to promote radial wicking. Continuous filament fibers, such as fiberglass, tend to promote wicking primarily along the axis of the filament—i.e., axial wicking. Through appropriate design, the filament also can be caused to promote radial wicking—i.e., outward from the axis of the filament. For example, radial wicking can be facilitated through wick construction with randomly oriented fiber or with fibrillation of the fiber surface. Such design particularly can be useful in the area of the filaments that are in proximity to or in contact with the heater as it can cause more of the precursor composition to be available for aerosolization in the specific area of the heater. A similar effect can be achieved such as through the use of particles or beads that can be sintered or otherwise interconnected to provide a continuous wick structure.

Further, the fibers of the wick material can be treated or coated to increase (or decrease, if desired) the wicking action of a fiber. Also, fiber material selection can be utilized to increase or decrease wicking action and thus control the wicking rate of a specific component of the aerosol precursor composition. Wicking also can be customized through choice of the dimensions of the fibers used in the wicks and the overall dimensions of the wick, including wick length and wick diameter.

The type of material used to form individual wicks also can be customized to transport specific types of compounds. For example, one or more wicks can be formed of hydrophobic materials so as to preferentially wick hydrophobic liquids. Further, one or more wicks can be formed of hydrophilic materials so as to preferentially wick hydrophilic liquids. Moreover, one or more wicks can be formed of materials that are neither hydrophilic nor hydrophobic, such as natural materials, so as to preferentially wick liquids that are neither significantly polar nor significantly non-polar.

In some embodiments, a wick can interact with a heater such that the heater essentially surrounds a portion of the wick. For example, as seen in the embodiment of FIG. 1, the heater is a wire coiled around the wick. In other embodiments, at least a portion of the heater can be within the wick. For example, a braided fiber sleeve can be used as the wick with a resistive heating element wire coil positioned inside the sleeve. Similarly, a heater wire can be embedded within a porous wicking structure or included within a woven or non-woven fabric.

Thus, a wick (or other transport element) can be matched to the component or group of components to achieve a desired transport rate based upon data showing the transport rate of the individual components with the chosen transport element. In this manner, through choice of appropriate transport element, the individual components of the aerosol precursor can be transported to the aerosolization zone at a substantially similar rate so that the composition of the formed aerosol more closely and consistently matches the original composition of the aerosol precursor composition as desired. Depending upon the components used in the aerosol precursor composition, transport element designs can be chosen to preferentially withdraw specific components from a common reservoir. Thus, a single reservoir containing the aerosol precursor composition can utilize two or more transport elements of different design so that one or more components of the aerosol precursor composition preferentially transports along one transport element and one or more separate components of the aerosol precursor composition preferentially transports along one or more different transport elements.

In certain embodiments, controlling transport of the separate components of the aerosol precursor composition particularly can be facilitated through utilization of a plurality of reservoirs, each reservoir utilizing a separate transport element to transport the components of the aerosol precursor composition to the aerosolization zone. One such example is shown in FIG. 4. As seen therein, the cartridge 90 includes a first reservoir layer 201 and a second reservoir layer 202, which are each layers of nonwoven fibers formed into the shape of a tube encircling the interior of the cartridge shell 91, in this embodiment. The first reservoir layer 201 includes at least one component of the aerosol precursor composition, and the second reservoir layer 202 includes at least one separate component of the aerosol precursor composition. The liquid components, for example, can be sorptively retained by the reservoir layers. In one embodiment, first reservoir layer 201 can include a polyol, such as glycerol, and a further component, such as nicotine, and second reservoir 202 can include a different polyol, such as propylene glycol. The first reservoir layer 201 is in fluid connection with a first transport element 301 (a wick in this embodiment), and the second reservoir layer 202 is in fluid connection with a second transport element 302 (a wick in this embodiment). The first wick 301 and the second wick 302 separately transport the components of the aerosol precursor composition stored in the respective reservoir layers via capillary action to the aerosolization zone 400 of the cartridge 90. As illustrated, the first wick 301 and the second wick 302 essentially merge in the aerosolization zone 400 to form a single wick that this in direct contact with the resistive heating element 50 that is in the form of a metal wire coil in this embodiment. As discussed herein, the wicks can be of the same design, or each wick can have a different design or construction (i.e., a different cross-sectional shape; a different type of fiber; a different type of material; have a different surface treatment or lack thereof, such as coatings or scoring of fibers; be woven or non-woven; include more or less fibers; include fibers of different dimensions; or have overall different dimensions). Use of separate wicks thus allows for customization of wicking of the separate components of the aerosol precursor composition, such as varying the wicking rate of specific components or varying the overall amounts of specific components that are wicked to the aerosolization zone.

In use, when a user draws on the article 10, the resistive heating element 50 is activated (e.g., such as via a puff sensor), and the components for the aerosol precursor composition are vaporized in the aerosolization zone 400. Drawing upon the mouthend 11 of the article 10 causes ambient air to enter the air intake 17 and pass through the central opening in the receptacle 60 and the central opening in the plug 65. In the cartridge 90, the drawn air passes through an air passage 230 in an air passage tube 220 and combines with the formed vapor in the aerosolization zone 400 to form an aerosol. The aerosol is whisked away from the aerosolization zone, passes through an air passage 260 in an air passage tube 250, and out the mouth opening 18 in the mouthend 11 of the article 10. After vaporization of the aerosol precursor composition in the aerosolization zone, further amounts of the separate components of the aerosol precursor composition transport along the wicks to the aerosolization zone via capillary action to at least partially saturate the wick in the aerosolization zone so additional aerosol can be formed when the user makes a further draw on the article. Of course, such exemplary embodiments should not be viewed as limiting the scope of the disclosure, and other conformations or components can be utilized to achieve the same function of forming an improved aerosol that is drawn from the article into the mouth of a user.

Although FIG. 4 illustrates the use of two separate reservoirs and two separate transport elements, the invention is not so limited. Rather, the number of reservoirs and transport elements used can vary depending upon the number of components used in the aerosol precursor composition and the need to separately transport the individual components to achieve a defined aerosol composition. Thus, a single reservoir can be used with a plurality of transport elements such that two or more components of the aerosol precursor stored in the single reservoir are separately transported from the reservoir to the aerosolization zone. Likewise, a plurality of reservoirs can be combined with a plurality of transport elements such that a plurality of separate components stored in the separate reservoirs are separately transported from the reservoirs to the aerosolization zone. This can include one, two, three, four, five, or even more reservoirs in combination with two, three, four, five, or even more transport elements.

Utilizing separate transport elements to transport separate components of the aerosol precursor composition can be useful to normalize the transport rate of the individual components to the aerosolization zone. For example, in the case of wicking, if one component is found to wick slower than the further components, the slower wicking component can be stored in a separate reservoir and transported to the aerosolization zone using a wick that is designed to increase the wicking rate of the component. In this manner, the wicking rates of the individual components can be normalized such that the wicking rates of the components of the aerosol precursor composition along their respective wicks each differ by about 25% or less, about 20% or less, about 15% or less, about 10% or less, or about 5% or less. Combinations of different types of transport elements also can be used to customize the transport rate of the various components of the aerosol precursor composition.

In addition to the use of a plurality of reservoirs and transport elements, a smoking article according to the present disclosure also can utilize a plurality of resistive heating elements. For example, FIG. 5 shows a cross-section of a cartridge 90 that is substantially identical to the cartridge of FIG. 4 except that two resistive heating elements (55, 56) are used to form aerosol by separately heating two or more components of the aerosol precursor composition. More particularly, visible in the illustration of this embodiment of a smoking article 10 is a shell 15, an aerosol passage tube 250 defining an aerosol passage 260, and a reservoir layer 202 positioned between the aerosol passage tube and the shell. Visible through the aerosol passage is a first transport element 301 that is in fluid communication with a first reservoir layer (not visible) and a second transport element 302 that is in fluid communication with the second reservoir layer 202. The first transport element 301 is in contact with a first resistive heating element 55 in the aerosolization zone 400, and the second transport element 302 is in contact with a second resistive heating element 56 also in the aerosolization zone. The first transport element transports a first component of the aerosol precursor composition from the first reservoir layer to the first resistive heating element, and the second transport element transports a second component of the aerosol precursor composition from the second reservoir layer to the second resistive heating element. In this way, the separate components transported to the separate heating elements can be heated to different temperatures to provide a more consistent aerosol for draw by a user. Further, the use of multiple heaters can allow for the use of smaller individual heaters, can allow for the use of smaller transport element being heated by the individual heaters, and can reduce the amount of electrical energy that is required by each heater to form the aerosol. The use of individual heaters likewise can allow for customized energy flow to each heater so that only the amount of electrical energy required to vaporize the specific component or components of the aerosol precursor composition delivered to that specific heater is delivered. The aerosolization temperature of the separate heaters can be substantially the same or can be different. In some embodiments, the aerosolization temperature of the separate heaters can differ by 2° C. or greater, 5° C. or greater, 10° C. or greater, 20° C. or greater, 30° C. or greater, or 50° C. or greater. When three or more heaters are used, fewer than all of the heaters can utilize aerosolization temperatures that are substantially the same. For example, when three heaters are used, the temperature of heaters 1 and 2 can be substantially the same, and the temperature of heater 3 can be different.

As noted previously, a smoking article according to the present disclosure is not limited to the use of only one or only two heating elements. Rather, the smoking article can include any number of heating elements up to the number of individual components forming the aerosol precursor composition.

In addition to the foregoing, the control body and cartridge can be characterized in relation to overall length. For example, the control body can have a length of about 50 mm to about 110 mm, about 60 mm to about 100 mm, or about 65 mm to about 95 mm. The cartridge can have a length of about 20 mm to about 60 mm, about 25 mm to about 55 mm, or about 30 mm to about 50 mm. The overall length of the combined cartridge and control body (or the overall length of a smoking article according to the invention formed of a single, unitary shell) can be approximately equal to or less than the length of a typical cigarette—e.g., about 70 mm to about 130 mm, about 80 mm to about 125 mm, or about 90 mm to about 120 mm.

Although the cartridge and the control body can be provided together as a complete smoking article or medicament delivery article generally, the components also can be provided separately. For example, the invention also encompasses a disposable unit for use with a reusable smoking article or a reusable medicament delivery article.

In specific embodiments, a disposable unit or cartridge according to the invention can be substantially identical to a cartridge as described above in relation to the appended figures. Thus, a disposable cartridge can comprise a substantially tubular shaped cartridge shell having a distal attachment end configured to engage a reusable smoking article or medicament delivery article and an opposing mouthend configured to allow passage of a formed vapor and any further inhalable materials to a consumer. The cartridge shell can define an interior cartridge space that includes additional cartridge components. Specifically, the interior cartridge space can include one or more reservoirs for storing a plurality of components of an aerosol precursor composition, one or more heaters positioned within a aerosolization zone for vaporizing the aerosol precursor composition, and a plurality of transport elements that transport the components of the aerosol precursor composition from the reservoir(s) to the heater(s), which can be described as being in fluid communication with each other. The inner surface of the cartridge shell can include an insulator layer thereon, and remaining components of the cartridge can be positioned within the interior cartridge space interior to the insulator layer. Optionally, one or more reservoirs can be provided as one or more layers of porous material that can function as the insulator layer as well as the reservoir. The cartridge can include further hardware (e.g., electrical wiring, electrical terminals, electrical contacts, etc) to facilitate current flow through the resistive heating element(s). Such further hardware can be used to provide an exterior electrical connection—i.e., means for forming an electrical connection to a power source when the disposable cartridge is engaged to a reusable control body. For example, the disposable cartridge can include an electrical plug projecting from the distal attachment end of the cartridge that can engage a receptacle in a control body. The disposable cartridge also can include attachment means, such as threads, beads, or the like to facilitate a mechanical connection with a control body.

In addition to the disposable unit, the invention further can be characterized as providing a separate control body for use in a reusable smoking article or a reusable medicament delivery article. In specific embodiments, the control body can generally be formed of a shell having a proximal attachment end (which can include one or more apertures therein) for receiving an attachment end of a separately provided cartridge. The control body further can include a power source (i.e., an electrical power source) that can be in electrical connection with one or more additional components of the control body, including components that facilitate electrical connection with a separately provided cartridge. The control body also can include further components, including components for actuating current flow into a heating member, and components for regulating such current flow to maintain a desired temperature for a desired time and/or to cycle current flow or stop current flow when a desired temperature has been reached or the heating member has been heating for a desired length of time. Thus, the control body can include a flow sensor and further control components. The control body further can comprise one or more pushbuttons associated with one or both of the components for actuating current flow. The control unit even further can comprise indicators, such as lights indicating the heater is heating and/or indicating the number of puffs remaining for a cartridge that is used with the control unit. The control body also can include attachment means, such as threads, beads, or the like to facilitate a mechanical connection with a cartridge.

Although the various figures described herein illustrate the control body and the cartridge in a working relationship, it is understood that the control body and the cartridge can exist as individual devices. Accordingly, any discussion otherwise provided herein in relation to the components in combination also should be understood as applying to the control body and the cartridge as individual and separate components.

In another aspect, the invention can be directed to kits that provide a variety of components as described herein. For example, a kit can comprise a control body with one or more cartridges. A kit further can comprise a control body with one or more charging components. A kit further can comprise a control body with one or more batteries. A kit further can comprise a control body with one or more cartridges and one or more charging components and/or one or more batteries. In further embodiments, a kit can comprise a plurality of cartridges. A kit further can comprise a plurality of cartridges and one or more batteries and/or one or more charging components. The inventive kits further can include a case (or other packaging, carrying, or storage component) that accommodates one or more of the further kit components. The case could be a reusable hard or soft container. Further, the case could be simply a box or other packaging structure.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed herein and that modifications and other embodiments are intended to be included within the scope of the appended claims. Although specific terms are employed herein, they are used in a generic and descriptive sense only and not for purposes of limitation.

The invention claimed is:

1. A smoking article comprising:

a mouthend comprising an opening;

an air passage through at least a portion of the smoking article and terminating at the opening;

a first reservoir containing a first aerosol precursor composition component;

a second reservoir comprising a second aerosol precursor composition component;

an aerosolization zone in which the first aerosol precursor composition component and the second aerosol precursor composition component are aerosolized, the aerosolization zone being in fluid communication with the air passage;

a first transport element providing fluid communication between the first reservoir and the aerosolization zone;

a second transport element separate from the first transport element providing fluid communication between the second reservoir and the aerosolization zone;

wherein the first aerosol precursor composition component and the second aerosol precursor composition component remain substantially separated until combination in the aerosolization zone;

wherein the transportation of the first aerosol precursor composition components and the seconds aerosol precursor composition component to the aerosolization zone is normalized such that a rate of transport of the first aerosol precursor composition component differs from a rate of transport of the second aerosol precursor composition component by less than a threshold amount, wherein the threshold amount is about 15%; and wherein the first aerosol precursor composition component and the second aerosol precursor composition component are aerosolized in the aerosolization zone when a user draws on the smoking article.

2. The smoking article of claim 1, wherein the aerosolization zone comprises a first aerosolization element and a second aerosolization element, the first aerosolization element in fluid communication with the first transport element and configured to aerosolize the first aerosol precursor composition component, and the second aerosolization element in fluid communication with the second transport element and configured to aerosolize the second aerosol precursor composition component.

3. The smoking article of claim 1, further comprising a heating element in fluid communication with the aerosolization zone.

4. The smoking article of claim 3, further comprising a control component adapted to operate the heating element to heat at least one of the first aerosol precursor composition component and the second aerosol precursor composition component.

5. The smoking article of claim 4, wherein the amount of heat applied by the heating element may be configured for control by the user to control the amount of aerosol generated by the smoking article.

6. The smoking article of claim 5, wherein the smoking article may be configured for control by the user to provide about 5 to about 50 Joules of heat per second.

7. The smoking article of claim 1, further comprising a heating element configured to pre-heat the first aerosol precursor composition component prior to its reaching the aerosolization zone.

8. The smoking article of claim 7, wherein the heating element is in substantial contact with one or both of the first reservoir and the first transport element.

9. The smoking article of claim 7, further comprising a control component adapted to operate the heating element to pre-heat the first aerosol precursor composition component.

10. The smoking article of claim 1, wherein the first aerosol precursor composition component comprises a nicotine solution and the second aerosol precursor composition component is a flavoring agent.

11. The smoking article of claim 1, wherein the first aerosol precursor composition component comprises a nicotine solution and the second aerosol precursor composition component comprises an organic acid.

12. The smoking article of claim 1, wherein the first transport element is selected from the group consisting of wicks, tubes, conduits, valves, and pumps.

13. The smoking article of claim 1, wherein the second transport element is selected from the group consisting of wicks, tubes, conduits, valves, and pumps.

14. The smoking article of claim 1, wherein the first transport element and the second transport element are formed of different materials.

15. The smoking article of claim 1, wherein the first transport element exhibits one or more different transport properties relative to the second transport element.

16. The smoking article of claim 1, wherein the first transport element and the second transport element differ in one or more of cross-sectional shape, material type, surface treatment, and overall dimensions.

17. The smoking article of claim 1, wherein the first transport element is a wick having a first wicking rate, and wherein the second transport element is a wick having a second, different wicking rate.

18. The smoking article of claim 17, wherein the wicks independently comprise a material selected from the group consisting of fibrous materials, carbon foams, sintered material, capillary tubes, temperature adaptive polymers, and combinations thereof.

19. The smoking article of claim 1, wherein the amount of the first aerosol precursor composition component and/or the amount of the second aerosol precursor composition component delivered to the aerosolization zone is configured for control by the user to control the amount of aerosol generated by the smoking article.

20. The smoking article of claim 19, wherein the smoking article may be configured for control by the user to deliver a wet total particulate matter (WTPM) content of about 1.0 mg to about 5.0 mg during a puff of approximately 2 seconds in duration.

21. The smoking article of claim 19, wherein the smoking article may be configured for control by the user to deliver a WTPM content of about 1.0 mg to about 4.0 mg in a total puff volume of about 25 ml to about 75 ml.

* * * * *